US008459497B2

(12) United States Patent
Milan et al.

(10) Patent No.: US 8,459,497 B2
(45) Date of Patent: Jun. 11, 2013

(54) APPARATUS FOR MIXING, COOLING, AND DISPENSING A CONTAINERIZED BEVERAGE

(75) Inventors: Michael Milan, Bethesda, MD (US); Robert C Hendricks, Columbia, MD (US); Jack Durban, Mission Viejo, CA (US)

(73) Assignee: Enterprise Express, Inc., Bethesda, MD (US)

( * ) Notice: Subject to any disclaimer, the term of this patent is extended or adjusted under 35 U.S.C. 154(b) by 1262 days.

(21) Appl. No.: 12/258,632

(22) Filed: Oct. 27, 2008
(Under 37 CFR 1.47)

(65) Prior Publication Data

US 2009/0179042 A1 Jul. 16, 2009

Related U.S. Application Data

(60) Provisional application No. 60/996,046, filed on Oct. 25, 2007.

(51) Int. Cl.
*B67D 7/80* (2010.01)

(52) U.S. Cl.
USPC ..... 221/150 R; 222/146.6; 62/3.7

(58) Field of Classification Search
USPC ..... 222/146.6; 221/150 R; 62/3.7
See application file for complete search history.

(56) References Cited

U.S. PATENT DOCUMENTS

| | | | | |
|---|---|---|---|---|
| 6,273,292 | B1 | 8/2001 | Milan | |
| 6,889,598 | B2 | 5/2005 | Wroblewski | |
| 2002/0131324 | A1 | 9/2002 | Farrell | |
| 2006/0162342 | A1 * | 7/2006 | Bhatti | 62/3.7 |
| 2009/0095771 | A1 * | 4/2009 | Hoover | 222/129.1 |

FOREIGN PATENT DOCUMENTS

WO 2006/017893 A1 2/2006

OTHER PUBLICATIONS

International Search Report and Written Opinion mailed Feb. 27, 2009 in corresponding PCT application PCT/US2008/012171.

* cited by examiner

*Primary Examiner* — Benjamin Layno
(74) *Attorney, Agent, or Firm* — Nixon & Vanderhye, P.C.

(57) ABSTRACT

A smoothie dispenser (20, 20S, 20A) comprises a frame (22); a smoothie receptacle storage section (24); and a receptacle conformed chiller section (26). The smoothie receptacle storage section (24) is provided within the frame (22) and configured to house plural smoothie receptacles (30) at a first temperature. The chiller section (26) is arranged to receive a selected smoothie receptacle released from the smoothie receptacle storage section and configured to crystallize contents of the selected smoothie receptacle. The receptacle conformed chiller section (26) is "receptacle conformed" in the sense that a surface of the chiller section is configured to conform to (e.g., have a surface of shape to mate with or to form substantially greater than linear contact with) at least a portion an exterior profile or periphery of the selected smoothie receptacle.

23 Claims, 26 Drawing Sheets

Fig. 11
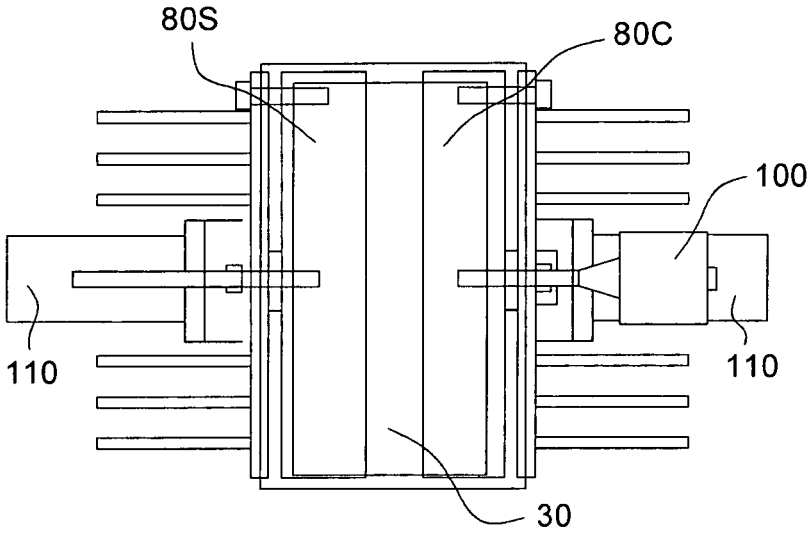
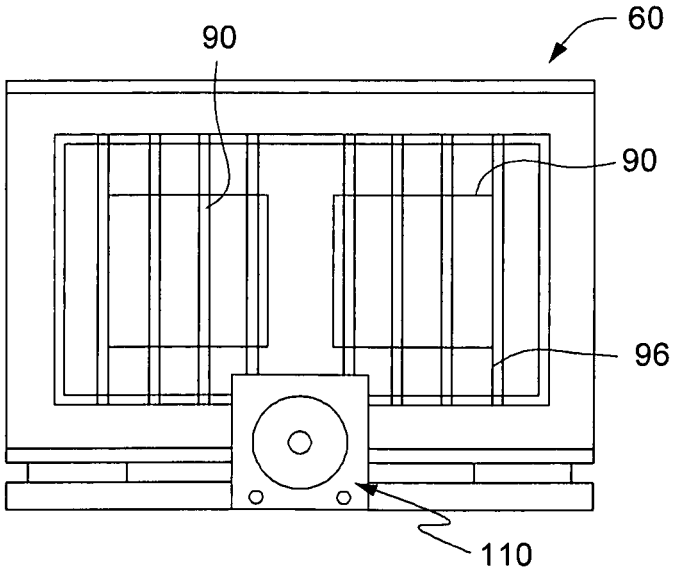
Fig. 12

Fig. 21A
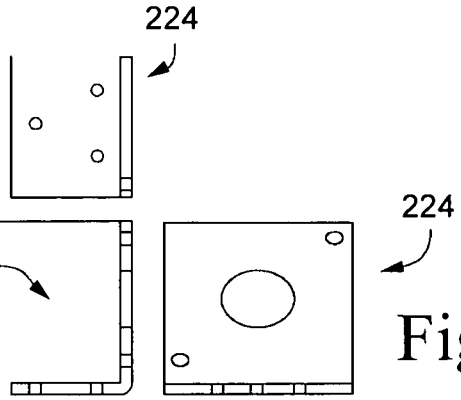
Fig. 21B
Fig. 21C
Fig. 22B
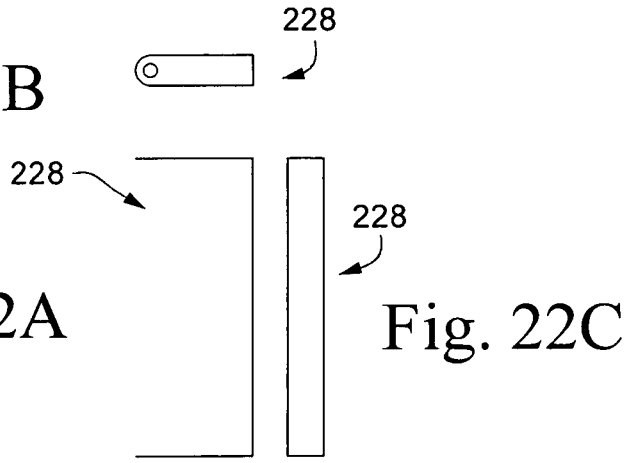
Fig. 22A
Fig. 22C
Fig. 23
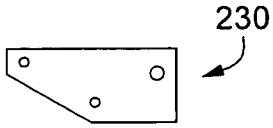
Fig. 24
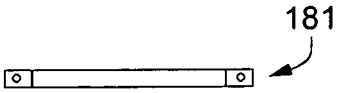

Fig. 25A
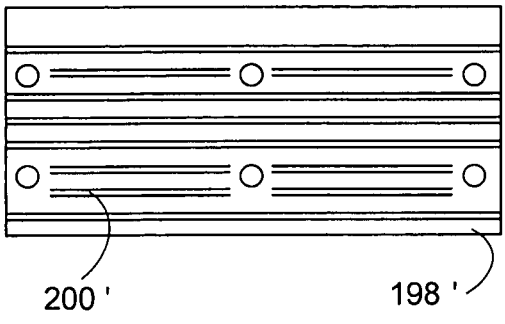
Fig. 25B
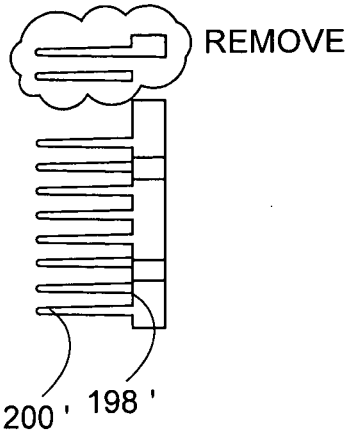
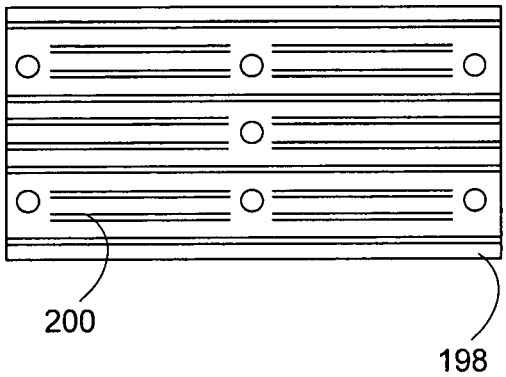
Fig. 26A
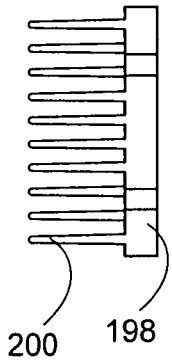
Fig. 26B
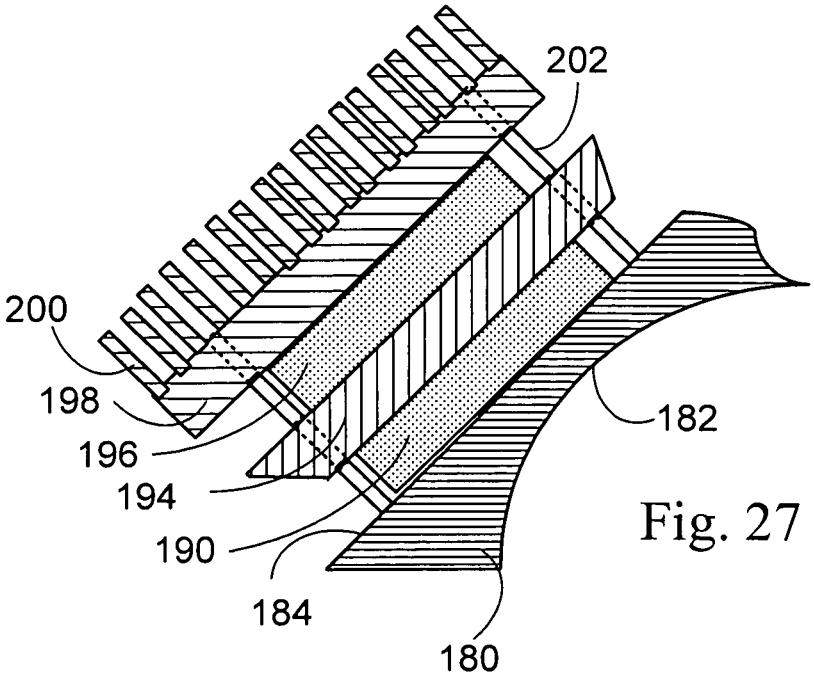
Fig. 27

APPARATUS FOR MIXING, COOLING, AND DISPENSING A CONTAINERIZED BEVERAGE

This application is a non-provisional application of U.S. Provisional Application 60/996,046 filed Oct. 25, 2007, entitled Apparatus for Mixing, Cooling, and Dispensing a Containerized Beverage, the entire contents of which are hereby incorporated by reference.

BACKGROUND

I. Technical Field

This invention pertains to method and apparatus for preparation of a crystallized beverage popularly known as a "smoothie".

II. Related Art and Other Considerations

A smoothie is a non-carbonated beverage that generally contains fruit or a mixture of different fruits that are pulverized to almost a liquid form and which is served at a freezing temperature to include ice crystals. In some forms a smoothie can include yogurt or ice cream.

Conventionally a smoothie is served to a consumer in a cup or container after the crystallized beverage has been prepared and/or discharged from a machine or other vessel. In other words, in conventional practice the smoothie ingredients are not, prior to selection or purchase by a consumer, stored in a package that will be received by the consumer. By contrast, U.S. Pat. No. 6,273,292, entitled "Dispensing Machine and Method of Dispensing A Blended Fruit Beverage" (incorporated herein by reference in its entirety) discloses, e.g., a smoothie dispensing machine and a method of dispensing a container of chilled smoothie beverage. The containers of U.S. Pat. No. 6,273,292, which can be cans or bottles, for example, have smoothie beverage contents sealed therein prior to the contents being lowered below thirty-two degrees Fahrenheit. U.S. Pat. No. 6,273,292 further discloses cooling and shaking of the smoothie upon selection by a consumer.

It is advantageous for a dispenser or vending machine to perform efficiently so that, e.g., a consumer does not wait long for delivery of the goods ordered or selected by the consumer. Moreover, it is desirable for a dispenser or vending machine to be capable of operating in a wide range of environments and operating conditions.

BRIEF SUMMARY

In one of this aspects, the technology disclosed herein concerns a smoothie dispenser comprising a frame; a smoothie receptacle storage section; and a receptacle conformed chiller section. The smoothie receptacle storage section is provided within the frame and configured to house plural smoothie receptacles at a first temperature. The receptacle conformed chiller section is arranged to receive a selected smoothie receptacle released from the smoothie receptacle storage section and configured to crystallize contents of the selected smoothie receptacle. As used herein, the terminology "receptacle conformed" chiller section means that a surface of the chiller section is configured to conform to (e.g., have a surface of shape to mate with or to form substantially greater than linear contact with) at least a portion an exterior profile or periphery of the selected smoothie receptacle.

In an example embodiment, the receptacle conformed chiller section comprises a thermal transfer assembly and an agitator. The thermal transfer assembly is configured to lower temperature contents of the selected smoothie receptacle to a second temperature for crystallizing the contents of the selected smoothie receptacle. In an example embodiment, the thermal transfer assembly comprises a thermal transfer member and a cooler. The thermal transfer member comprises a receptacle contact surface configured to conform to at least a portion an exterior profile of the selected smoothie receptacle and thermal transfer surface.

a module mating surface. The thermoelectric cooling module is mounted on the module mating surface of the thermal transfer member. The agitator is configured to agitate the thermal transfer assembly during lowering of the temperature of the contents of the selected smoothie receptacle.

In an example embodiment, the cooler is a thermoelectric cooling module and the thermal transfer surface of the thermal transfer assembly is a module mating surface. In this example embodiment, the thermoelectric cooling module can function as a heat pump. In other embodiments, the thermal transfer surface can be coupled to any suitable cooler, such as tubes or container(s) which carry refrigerant or other cooled substance, for example.

In an example embodiment, the receptacle contact surface is configured to conform to at least a portion an arcuate exterior profile of the selected smoothie receptacle. For example, the receptacle contact surface can be configured to conform to at least a portion of a semi-cylindrical sidewall of a can or bottle.

In an example embodiment, the thermal transfer assembly further comprises two thermal transfer members and an actuator. The actuator is configured to move the two thermal transfer members into an engaged position wherein the selected smoothie receptacle is clamped between the two thermal transfer members.

In an example embodiment, the smoothie dispenser further comprises a controller configured to initiate and terminate a chill cycle of operation wherein the contents of the selected smoothie receptacle are lowered to the second temperature for crystallizing the contents of the selected smoothie receptacle. In an example implementation, the controller is also configured to operate the actuator the clamping the selected smoothie receptacle between the two thermal transfer members.

In an example implementation, the smoothie dispenser further comprises a temperature sensor configured to monitor the temperature of the selected smoothie receptacle and to generate a signal in accordance therewith. In response to the signal provided by the temperature monitor the controller is configured to initiate and terminate the chill cycle.

In an example implementation, the controller is configured to reverse operation of the thermoelectric cooling module and thereby defrost the thermal transfer member for facilitating release of the selected smoothie receptacle.

In an example embodiment, the wherein the actuator is configured to reciprocate the two thermal transfer members into the engaged position. In another example embodiment, at least one of the two thermal transfer members is configured to pivot into the engaged position upon actuation of the actuator.

In an example embodiment, the thermal transfer assembly further comprises a mounting plate. A first of the two transfer members is mounted for location on a first side of the mounting plate and a second of the two transfer members is pivotally mounted for location on a second side of the mounting plate. The mounting plate is configured with a cavity therein to accommodate the selected smoothie receptacle when clamped between the two thermal transfer members. In an example implementation, the first of the two transfer members is pivotally mounted for location on the first side of the mounting plate and the second of the two transfer members is pivotally mounted for location on the second side of the mounting plate. In an example implementation, the actuator is also mounted on the mounting plate.

In an example embodiment, the thermal transfer member comprises plural module mating surfaces and corresponding plural thermoelectric cooling modules mounted on the respective plural module mating surfaces. For example, in one implementation each thermal transfer member comprises three module mating surfaces.

In an example embodiment, the thermal transfer assembly of the smoothie dispenser further comprises a finned heat exchanger connected to the thermoelectric cooling module.

In an example embodiment, the thermal transfer assembly further comprises an auxiliary thermal transfer member connected to the thermoelectric cooling module, and an auxiliary thermoelectric cooling module connected between the auxiliary thermal transfer member and the finned heat exchanger.

In an example embodiment, the chiller section further comprises a receptacle ejector configured to eject the selected smoothie receptacle from the thermal transfer member. In an example implementation, the thermal transfer member is configured to accommodate the receptacle ejector at least partially within the thermal transfer member.

In an example embodiment, the agitator comprises an eccentrically weighted motor attached to the thermal transfer assembly.

In another of its aspects, the technology disclosed herein concerns a vending machine which comprises a frame; a receptacle section provided within the frame and configured to house plural receptacles; an electrical system configured to operate at least one of storing and dispensing of the receptacles; and, an electromagnetic radiation collection/conversion member (e.g., solar cell) mounted on the frame and configured to supply electrical power to the electrical system.

In an example embodiment, the electromagnetic radiation collection/conversion panel (e.g., solar cell) is provided on a roof panel of the frame. In view, e.g., of the provision of the solar cell, the vending machine (e.g., dispenser) is energy-independent and capable of standing alone without receipt of external line current.

In an example implementation of the solar-cell operated vending machine, the storage section is configured to house plural smoothie receptacles at a first temperature. In such smoothie-specific example implementation, the vending machine further comprises a chiller section arranged to receive a selected smoothie receptacle released from the smoothie receptacle storage section and configured to crystallize contents of the selected smoothie receptacle by lowering the temperature of the contents of the selected smoothie receptacle to a second temperature, and the electrical system is configured to operate the chiller section. In an example implementation, the smoothie-specific vending machine further comprises a cooling section configured to maintain the smoothie receptacle storage at the first temperature, and the electrical system is configured also to operate the cooling section.

In another of its aspects, the technology disclosed herein concerns a vending machine which comprises a frame; a receptacle section provided within the frame and configured to house plural receptacles; and an inventory remote reporting system which reports by wireless communications to a central station the fact that a bin of the receptacle section has a low inventory of receptacles.

In another of its aspects, the technology disclosed herein concerns a vending machine which comprises a frame; a receptacle section provided within the frame and configured to house plural receptacles; a receptacle discharge chute; and a credit account management system which is configured to manage prepayment by a customer for future purchase of vended product at the vending machine and/or another vending machine in network therewith.

In another of its aspects, the technology disclosed herein concerns a smoothie dispenser comprising a frame; a smoothie receptacle storage section; a smoothie additive storage section; a chiller section; and, an additive discharge mechanism. The smoothie receptacle storage section is provided within the frame and configured to house plural smoothie receptacles at a first temperature.

The smoothie additive storage section is provided within the frame and configured to house the smoothie additive. A consumer-operated product selection unit is provided on the frame and is configured to receive customer input for specifying choice of a selected smoothie receptacle and customer input for selecting a smoothie additive. The smoothie additive comprises a substance appropriate for introduction into contents of the selected smoothie receptacle by the customer after discharge of the selected smoothie receptacle from the dispenser. The chiller section is arranged to receive a selected smoothie receptacle released from the smoothie receptacle storage section and configured to crystallize contents of the selected smoothie receptacle by lowering the temperature of the contents of the selected smoothie receptacle to a second temperature. The additive discharge mechanism configured to discharge from the frame the selected smoothie additive in coordination with discharge of the chilled selected smoothie receptacle.

In an example embodiment, the consumer-operated product selection unit is configured to receive consumer input for optionally selecting the smoothie additive. In an example embodiment, the consumer-operated product selection unit is further configured to receive customer input for selecting one of plural possible types of smoothie additives, and wherein the smoothie additive storage section is configured to and house the plural possible types of smoothie additives.

In another of its aspects, the technology disclosed herein concerns a smoothie chiller unit which can be sold or installed as a separate unit for use in a dispenser or vending machine, or which can stand alone as a separate chilling unit for chilling smoothie receptacles individually placed therein. The smoothie chiller unit comprises a thermal transfer assembly and an agitator. The thermal transfer assembly is configured to lower temperature contents of a smoothie receptacle for crystallizing the contents of the smoothie receptacle. The thermal transfer assembly comprises a thermal transfer member comprising a receptacle contact surface configured to conform to at least a portion an exterior profile of the smoothie receptacle and a thermal transfer surface; and, cooler coupled to the thermal transfer surface. The agitator is configured to agitate the thermal transfer assembly during lowering of the crystallizing of the contents of the smoothie receptacle. In a non-limiting example implementation, the thermal transfer assembly comprises two thermal transfer members and an actuator configured to move the two thermal transfer members into an engaged position wherein the smoothie receptacle is clamped between the two thermal transfer members.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

FIG. 11 is a bottom view of the portions of the chiller section of FIG. 10 and further including agitator apparatus.

FIG. 12 is a right side view of the portions of the chiller section of FIG. 10 and further including agitator apparatus.

FIG. 21A is a top view of an actuator bracket for a chiller unit core of the smoothie dispenser embodiment of FIG. 15.

FIG. 21B is a front view of the actuator bracket of FIG. 21A.

FIG. 21C is a side view of the actuator bracket of FIG. 21A.

FIG. 22A is a top view of an actuator yoke for a chiller unit core of the smoothie dispenser embodiment of FIG. 15.

FIG. 22B is a front view of the actuator yoke of FIG. 22A.

FIG. 22C is a side view of the actuator yoke of FIG. 22A.

FIG. 23 is a front view of a yoke bracket for a chiller unit core of the smoothie dispenser embodiment of FIG. 15.

FIG. 24 is a top view of a hinge rod for a chiller unit core of the smoothie dispenser embodiment of FIG. 15.

FIG. 25A is a top view of fin-truncated finned heat exchanger for a chiller unit core of the smoothie dispenser embodiment of FIG. 15.

FIG. 25B is a side view of the finned heat exchanger of FIG. 25A.

FIG. 26A is a top view of standard finned heat exchanger for a chiller unit core of the smoothie dispenser embodiment of FIG. 15.

FIG. 26B is a side view of the finned heat exchanger of FIG. 26A.

FIG. 27 is a sectioned side view of a portion of a thermal transfer member together with a stacked arrangement of elements provided thereon.

DETAILED DESCRIPTION

In the following description, for purposes of explanation and not limitation, specific details are set forth such as particular architectures, interfaces, techniques, etc. in order to provide a thorough understanding of the present invention. However, it will be apparent to those skilled in the art that the present invention may be practiced in other embodiments that depart from these specific details. That is, those skilled in the art will be able to devise various arrangements which, although not explicitly described or shown herein, embody the principles of the invention and are included within its spirit and scope. In some instances, detailed descriptions of well-known devices, circuits, and methods are omitted so as not to obscure the description of the present invention with unnecessary detail. All statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Thus, for example, it will be appreciated by those skilled in the art that block diagrams herein can represent conceptual views of illustrative circuitry embodying the principles of the technology. Similarly, it will be appreciated that any flow charts, state transition diagrams, pseudocode, and the like represent various processes which may be substantially represented in computer readable medium and so executed by a computer or processor, whether or not such computer or processor is explicitly shown.

The functions of the various elements including functional blocks labeled or described as "processors" or "controllers" may be provided through the use of dedicated hardware as well as hardware capable of executing software in association with appropriate software. When provided by a processor, the functions may be provided by a single dedicated processor, by a single shared processor, or by a plurality of individual processors, some of which may be shared or distributed. Moreover, explicit use of the term "processor" or "controller" should not be construed to refer exclusively to hardware capable of executing software, and may include, without limitation, digital signal processor (DSP) hardware, read only memory (ROM) for storing software, random access memory (RAM), and non-volatile storage.

Figure 1:
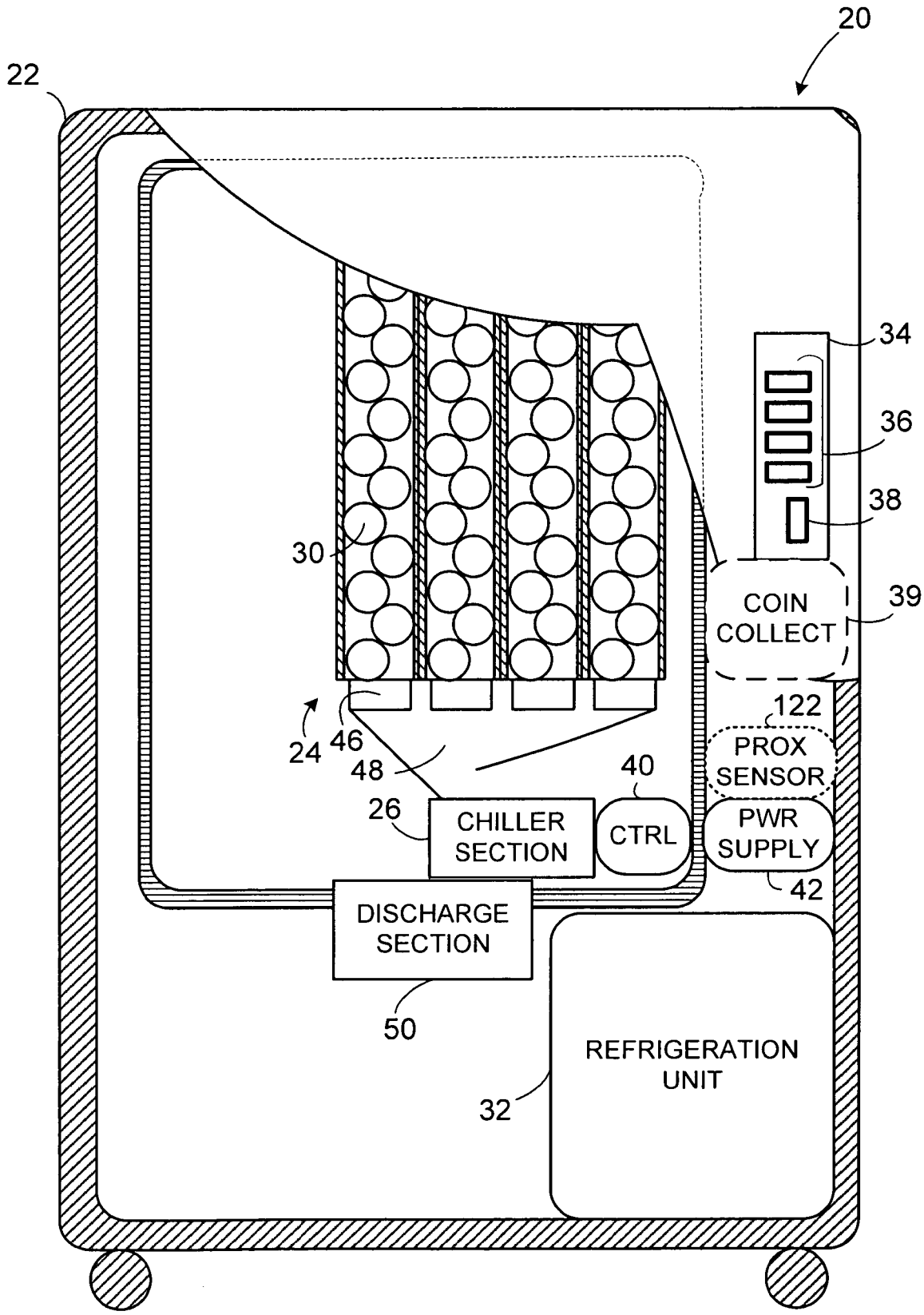
FIG. 1 is a front, partially sectioned view of a smoothie dispenser according to an example embodiment.

FIG. 1 illustrates a first example embodiment of a smoothie dispenser 20. In its general aspects, smoothie dispenser 20 comprises cabinet or frame 22; smoothie receptacle storage section 24; and, receptacle conformed chiller section 26. In an example embodiment, frame 22 may have the size and general external appearance of a conventional vending machine for soft drinks or the like. In fact, in one example embodiment the smoothie dispenser 20 may be realized by using a frame and select components which reside in a conventional beverage vending machine such as those marketed by Dixie-Narco, for example, as augmented by other functionalities such as the receptacle conformed chiller section 26 described herein.

Smoothie receptacle storage section 24 is provided within frame 22 and configured to house plural smoothie receptacles 30 at a first temperature. The smoothie receptacles 30 can take any appropriate form or size, such as the form of cans (e.g., aluminum cans) or bottles, for example. In one particular example embodiment, the smoothie receptacle storage section 24 is maintained at the first temperature, at least in part, by refrigeration unit 32 housed in frame 22.

As illustrated in FIG. 1, smoothie receptacle storage section 24 can be partitioned or otherwise comprise plural storage bins, with differing bins preferably being stocked with respectively differing brands or flavors of smoothie beverage. As a non-limiting example, four such bins are illustrated in the smoothie receptacle storage section 24 of FIG. 1. In view of the variety of selection proffered, smoothie dispenser 20 comprises consumer-operated product selection unit 34 in the form of an exterior panel or interactive display on the exterior of frame 22.

In the example embodiment of FIG. 1, consumer-operated product selection unit 34 includes a bank of product selectors 36 (e.g., buttons, levers, switches or the like). An appropriate product selector is associated with each bin of smoothie receptacle storage section 24 and thus each brand or flavor of smoothie beverage vended by smoothie dispenser 20. In addition, consumer-operated product selection unit 34 typically includes a payment receipt mechanism 38 such as a coin slot or bill receptor or credit card reader, for example. A currency collection mechanism 39 may also be provided, preferably in proximity to payment receipt mechanism 38.

Smoothie dispenser 20 further comprises controller 40 which can include, for example, suitable electronics and other circuitry, including but not limited to that hereinafter described. Although shown as collocated in FIG. 1, controller 40 may be distributed at differing locations within frame 22. Controller 40 and other electrically-operated units or functionalities of smoothie dispenser 20 are connected to power supply 42. Low dissipation high current MOSFETs can be used to drive the solenoids and thermoelectric elements. Electrical connection of controller 40 to electrically-operated units or elements such as solenoids, detectors, and motors described herein are not necessarily illustrated, but their existence and nature of the connection(s) are understood by the person skilled in the art.

Each bin of smoothie receptacle storage section 24 is provided with receptacle release mechanism 46 which is actuated in response to actuation or operation of a corresponding one of the product selectors of selector bank 36. Receptacle drop chute 48 is provided beneath the bins of smoothie receptacle storage section 24, so that any smoothie receptacle 30 released by opening of receptacle release mechanism 46 falls downward into chiller section 26. Chiller section 26 thus can receive a selected smoothie receptacle 30 released from the smoothie receptacle storage section. As explained hereinafter, in its various example and non-limiting embodiments the chiller section 26 is configured to crystallize contents of the selected smoothie receptacle. Upon completion of the chilling operation performed by chiller section 26, the chilled smoothie receptacle 30 is unloaded into discharge section 50. When the chilled smoothie receptacle 30 has been placed or fallen into discharge section 50, the consumer can retrieve the discharged smoothie receptacle 30 through a suitable opening, window, or hatch in an exterior panel on the front of frame 22.

When spoken of generically, the chiller section is referenced herein as chiller section 26. The generic description of chiller section 26 encompasses various embodiments. When a particular embodiment is specifically described or contemplated, an appropriate suffix may appear after the reference numeral, e.g., chiller section 26A or chiller section 26B, for example. The generic chiller section 26 comprises both a thermal transfer assembly and an agitator. The thermal transfer assembly of the chiller section 26 is configured to lower temperature contents of the selected smoothie receptacle to a second temperature (e.g., below thirty two degrees Fahrenheit) for crystallizing the contents of the selected smoothie receptacle.

Figure 2:
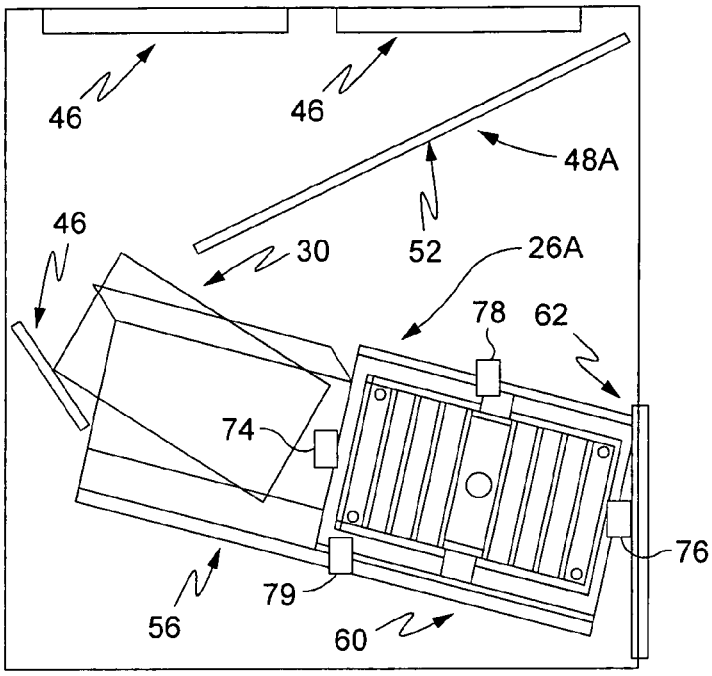
FIG. 2 is a schematic view of portions of an example embodiment smoothie dispenser showing a first example embodiment of a chiller section therefor.

FIG. 2 illustrates portions of a smoothie dispenser according to an example embodiment, and particularly portions of a receptacle drop chute 48A and receptacle conformed chiller section 26A according to an example embodiment. As shown in FIG. 2, receptacle drop chute 48A comprises receptacle chute guide walls 52 which direct a smoothie receptacle 30 released from smoothie receptacle storage section 24 into chiller guide funnel 56. The chiller guide funnel 56 and chiller unit 60 of chiller section 26A are further illustrated in FIG. 3. In the example illustrated in FIG. 2 and FIG. 3, the chiller guide funnel 56 and chiller unit 60 are oriented at an approximate twenty degree angle to the horizontal. The chiller guide funnel 56 serves as a guide and dampening unit as the smoothie receptacle 30 is loaded into chiller unit 60. Delivery door 62 is provided downstream from chiller unit 60 so that, upon completion of the chilling mode, the chilled smoothie receptacle 30 can be delivered into discharge section 50.

Figure 3:
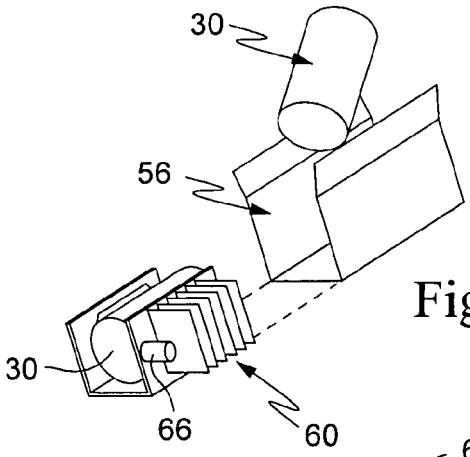
FIG. 3 is an exploded schematic view showing discharge of a smoothie receptacle into the chiller section of the example embodiment of FIG. 2.

FIG. 4-FIG. 13, in addition to FIG. 2-FIG. 3, illustrate various aspects and/or constituent components and/or operational acts of chiller unit 60. As shown in FIG. 3, chiller unit 60 comprises an essentially U-shaped chiller unit frame 64 which comprises two sidewalls and a bottom wall. Receptacle retention/release solenoid 66 is provided on one of the sidewalls of unit frame 64.

Figure 13:
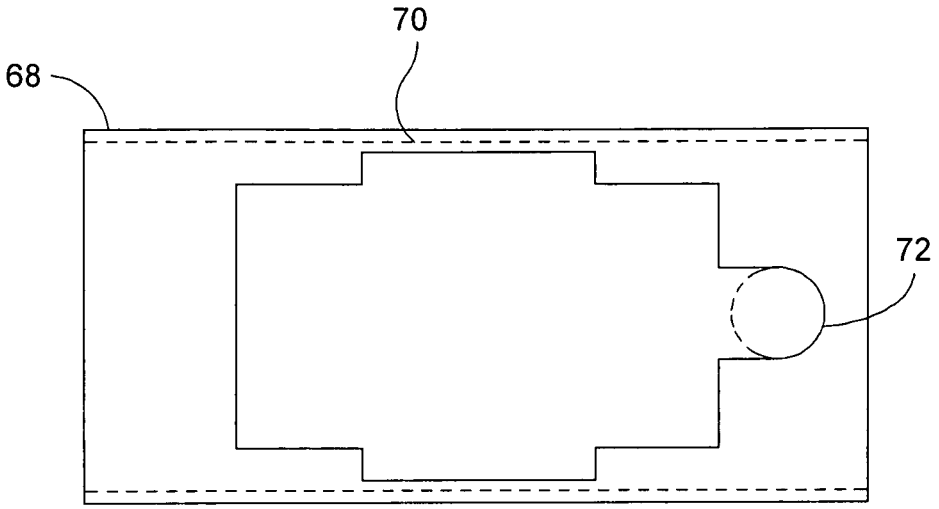
FIG. 13 is a side view of a particular sidewall of a unit frame 64 of a chiller unit of the chiller section of an example embodiment.

FIG. 13 shows the particular sidewall 68 of unit frame 64 on which receptacle retention/release solenoid 66 is provided. A plunger of receptacle retention/release solenoid 66 is situated and actuatable to retain or release a smoothie receptacle 30 situated in unit frame 64. The sidewall 68 is provide with a cavity 70 configured to accommodate other components of chiller unit 60. The cavity 70 includes cavity section 72 which is configured to accommodate receptacle retention/release solenoid 66. A comparable sidewall is provided opposite the sidewall 68 of FIG. 13, having a cavity 70 but without solenoid-accommodating cavity section 72.

Figure 4:
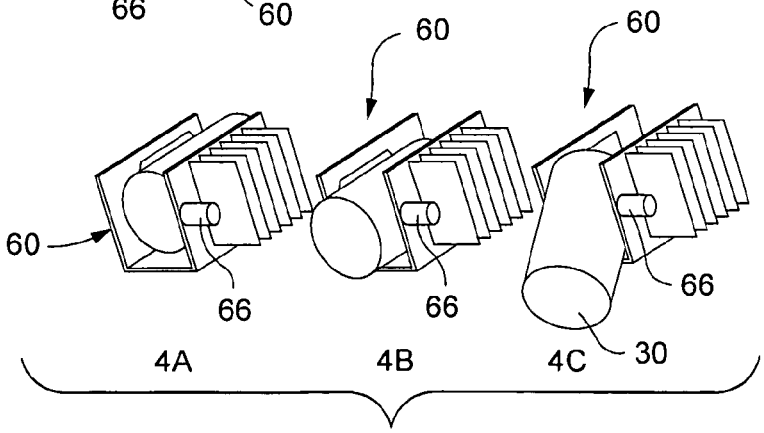
FIG. 4 is a series of sequential schematic views showing a drop sequence for a smoothie receptacle in the chiller section of the example embodiment of FIG. 2.
Figure 5:
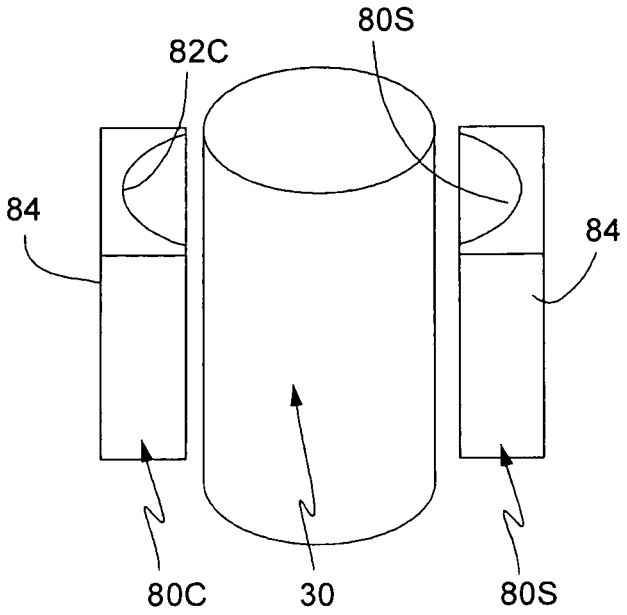
FIG. 5 is a schematic side perspective view showing thermal transfer members of the chiller section of the example embodiment of FIG. 2 relative to an example smoothie receptacle.
Figure 6:
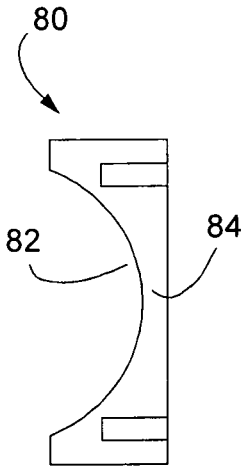
FIG. 6 is a side view of the thermal transfer member of FIG. 5.
Figure 7:
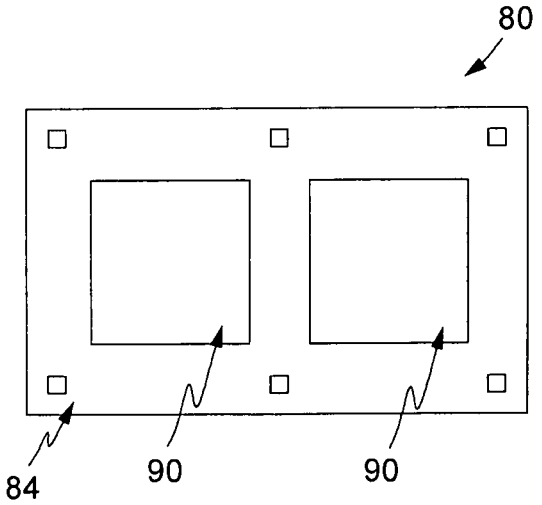
FIG. 7 is a rear view of the thermal transfer member of FIG. 5.

FIG. 4 shows in its various frames 4A, 4B, and 4C, e.g., the operation of receptacle retention/release solenoid 66. Frame 4A of FIG. 4 shows the act of retaining a smoothie receptacle 30 (when the receptacle retention/release solenoid 66 is unenergized. Frame 4B of FIG. 4 shows the act of beginning the dropping or discharge of smoothie receptacle 30 (when the receptacle retention/release solenoid 66 is energized. Frame 4C of FIG. 4 shows the act of near release of smoothie receptacle 30 (when the receptacle retention/release solenoid 66 is energized).

FIG. 2-FIG. 4 thus depict a basic sequence of operation. FIG. 3 shows the chiller guide funnel 56 which serves as a receptacle guide and dampener assembly and which receives the receptacle from the bins of smoothie receptacle storage section smoothie receptacle storage section 24 (e.g., from vendor can column feeds) upon completion of a transaction. The chiller guide funnel 56 receives and dampens the falling receptacle and guides it into the quick chiller and agitator assembly (e.g., chiller unit 60).

As shown in representative fashion in FIG. 2, the chiller unit 60 is also provided with various detectors, such as, for example, receptacle entry detector 74; receptacle exit detector 76, temperature sensor/detector 78, and vibration sensor/detector 79. These various detectors/sensors can be positioned in appropriate locations depending on the geometry and configuration of the monitored structure, e.g., unit frame 64. The temperature sensor/detector 78 can be employed to regular temperature of chiller unit 60. The vibration sensor/detector 79 can be used to detect and validate agitation excursion.

Figure 8:
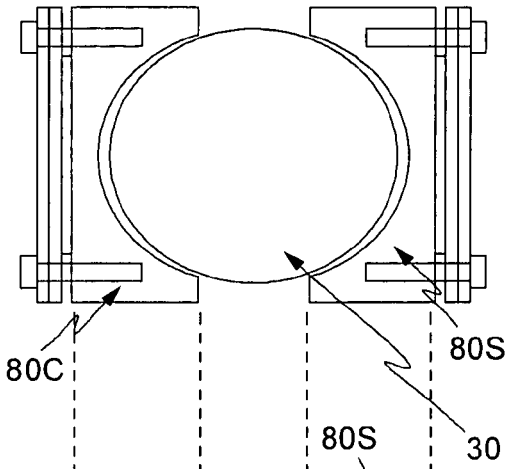
FIG. 8 is a front schematic view of relative positions of thermal transfer members of the chiller section of the example embodiment of FIG. 2 relative to an example smoothie receptacle in a standby mode.
Figure 9:
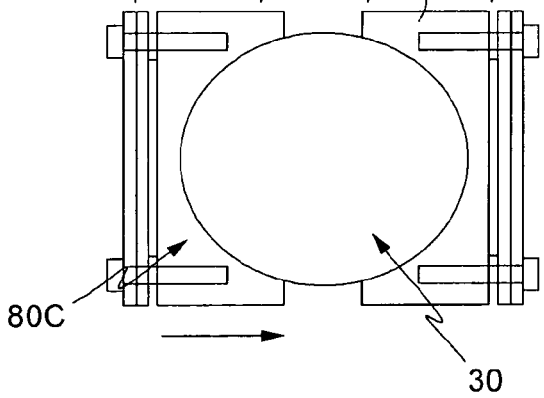
FIG. 9 is a front schematic view of relative positions of thermal transfer members of the chiller section of the example embodiment of FIG. 2 relative to an example smoothie receptacle in a chill mode.

The cavities 70 of the sidewalls of chiller unit 60 (such as sidewall 68 of FIG. 18) are configured to receive other chiller components, including thermal transfer members. As shown, for example, in FIG. 8 and FIG. 9, the thermal transfer members for the example embodiment take the form of two opposed chill plates, e.g., chill plate 80S and chill plate 80C. In one particular implementation, the chill plate 80S is a member which remains essentially stationary as it protrudes through the cavity 70 of sidewall 68, whereas chill plate 80C is a clamping chill plate which can be actuated to reciprocate between a standby position (as shown in FIG. 8) and a chill mode position (as shown in FIG. 9). In an example operation, in the standby position (shown in FIG. 8) the chill plate 80C is separated by about 0.2 inch from smoothie receptacle 30.

As used herein, the terminology "receptacle conformed" chiller section means that a surface of the chiller section is configured to conform to (e.g., have a surface of shape to mate with or to form substantially greater than linear contact with) at least a portion an exterior profile or periphery of the selected smoothie receptacle. Thus, as seen (for example) in FIG. 5, FIG. 6, FIG. 8, and FIG. 9, in the illustrated, non-limiting example the chill plates 80 have an arcuate receptacle contact surface 82. For example, the receptacle contact surface can be configured to conform to at least a portion of a semi-cylindrical sidewall of a can or bottle. An example can is a standard aluminum soda can which is approximately 4.85 inches tall by 2.60 inches wide.

The surfaces of the thermal transfer members 80 (e.g., chill plate 80S and chill plate 80C) which are opposite the receptacle contact surface 82 is an essentially flat surface which serves as a module mating surface 84.

Figure 10:
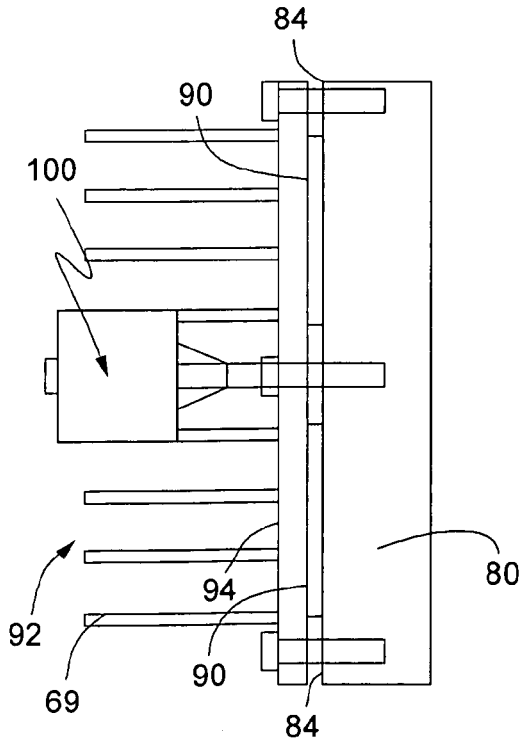
FIG. 10 is an enlarged side view of a portion of a thermal transfer member of the chiller section of the example embodiment of FIG. 2, further showing an linear motor which serves as an actuator.

The chiller unit 60A not only comprises thermal transfer members 80 (e.g., chill plate 80S and chill plate 80C), but also one or more thermoelectric cooling modules. In this regard, FIG. 8-FIG. 10 show thermoelectric cooling modules 90 mounted on the module mating surfaces 84 of chill plate 80S and chill plate 80C. In the illustrated example implementation, two thermoelectric cooling modules 90 are shown mounted on each module mating surface 84. Note that FIG. 10 only illustrates a rear portion of each thermal transfer members 80 (thereby not including the receptacle contact surface 82), with the thermoelectric cooling modules 90 mounted thereon.

Each thermal transfer member 80 further comprises finned heat exchanger 92 connected to each thermoelectric cooling module 90. The finned heat exchanger 92 comprises heat exchanger base plate 94 and fins 96 which, in the illustrated embodiment, extend essentially orthogonally from the heat exchanger base plate 94 upon which they are mounted. The heat exchanger base plate 94 is affixed to module mating surface 84 of thermal transfer member 80, so that the thermoelectric cooling module(s) 90 are essentially sandwiched between module mating surface 84 and thermoelectric cooling module 90.

In addition to the two thermal transfer members 80, in an example embodiment, the thermal transfer assembly further comprises actuator 100. Actuator 100 is configured to move the two thermal transfer members 80 into an engaged (e.g., clamped) position wherein the selected smoothie receptacle 30 is clamped between the two thermal transfer members. In the example implementation of FIG. 8 and FIG. 9, for example, actuator 100 is operated to move the chill plate 80C between its standby mode wherein chill plate 80C is slightly separated from smoothie receptacle 30 (FIG. 8) and its chill mode wherein the chill plate 80C is essentially in contact with the clamped smoothie receptacle 30 (FIG. 9). In the example embodiment of FIG. 10, actuator 100 takes the form of a linear motor (e.g., DC stepper motor) which is connected to translate chill plate 80C.

FIG. 11 and FIG. 12 show that chiller unit 60 further comprises agitator apparatus used to agitate the thermal transfer assembly both during the lowering of the temperature of the contents of the selected smoothie receptacle and as a means of overcoming any stiction points in the path to its final destination. This novel use of an already available vibration source to keep the can moving all the way from drop to chiller/agitator insertion eliminates the need for secondary vibrator devices. FIG. 11 and FIG. 12 particularly show employment of two agitators 110 which are positioned to interface with opposing sidewalls of unit frame 64. In an illustrated example embodiment, the agitators 110 can take the form of pulsed DC solenoids which vibrate, agitate, or rock the smoothie receptacle 30 in chiller unit 60.

The controller 40 is configured to initiate and terminate a chill cycle of operation wherein the contents of the selected smoothie receptacle are lowered to the second temperature for crystallizing the contents of the selected smoothie receptacle. In an example implementation, controller 40 is also configured to operate other aspects of smoothie dispenser 20, such as (for example) the clamping by actuator 100 of the selected smoothie receptacle between the two thermal transfer members, operation of receptacle retention/release solenoid 66, and operation of agitators 110, for example. To this end, controller 40 can be configured with hardwired logic or a software program (stored on computer readable medium) in order to perform various acts or steps, representative such example acts or steps being illustrated in FIG. 14.

Figure 14:
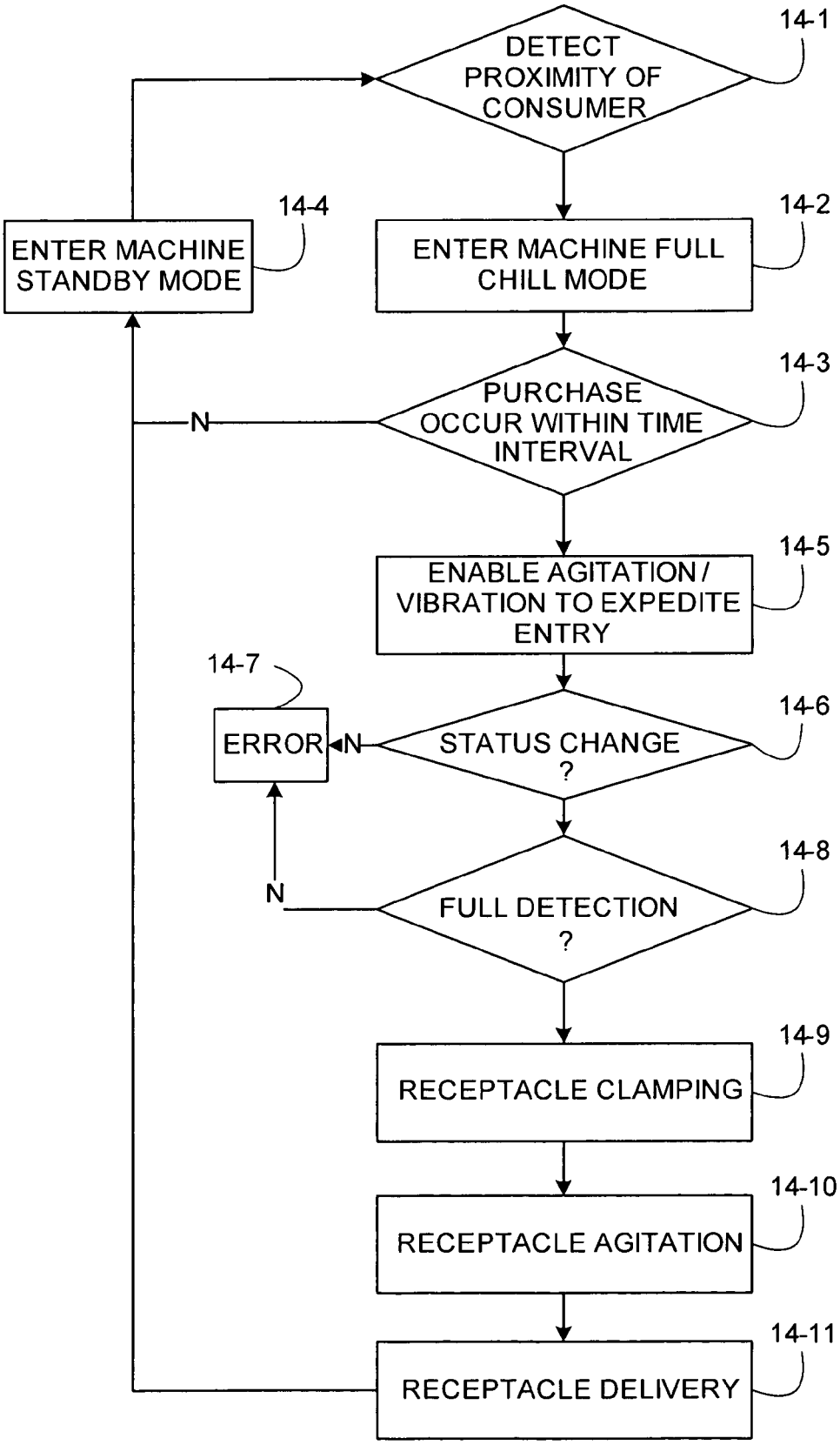
FIG. 14 is a flowchart showing basic acts or steps involved in a method of operation of an example embodiment smoothie dispenser.

Act 14-1 of the procedure of FIG. 14 comprises detecting a potential consumer or patron. Detection of the potential consumer can be accomplished using proximity detector 112. The proximity detector 122 can be of conventional type, and as shown in FIG. 1 can be placed on frame 22 near consumer-operated product selection unit 34.

Upon detection of a potential consumer or patron, as act 14-2 the chiller unit 60 is taken out of standby mode and put into full chill mode. In the standby mode, power is applied to refrigeration unit 32 or other suitable air conditioning apparatus for cooling smoothie receptacle storage section 24, but not to chiller unit 60. However, in the full chill mode, power is applied to the thermoelectric cooling modules 90 of chiller unit 60 in anticipation of a smoothie receptacle 30 soon being loaded into chiller unit 60.

Act 14-3 comprises the controller 40 checking whether, within a preset period of time, no purchase is made by the consumer or patron whose presence had been perceived by proximity detector 112. If no purchase is made within the preset time, the controller 40 returns the smoothie receptacle 30 to its standby mode. In the standby mode, power is applied to refrigeration unit 32 but not operate the chilling operation of chiller unit 60.

However, if it is determined at act 14-3 that a purchase is made within the preset period of time, the smoothie dispenser 20 enters a processing mode which comprises a sequence of acts depicted in representative manner by act 14-5 through act 14-11 of FIG. 14. Consummation of the purchase is detected, for example, by receipt of payment (via payment receipt mechanism 38) and/or activation of one of product selectors of selector bank 36.

Act 14-5 of the processing mode of FIG. 14 comprises execution of an agitation/vibration routine. The agitation/vibration routine of act 14-5 includes enablement of the agitator apparatus (e.g., agitators 110) in vibration mode, which in an illustrated example can involve pulsing of a solenoid at high speed and at a low duty cycle to produce fractional excursion forward and reverse linear motion. This will act as a dynamic anti-stiction function to expedite entry of the selected smoothie receptacle 30 into and out of chiller unit 60 and chiller unit frame 64 in particular.

Act 14-6 comprises checking a status change from the chiller entry proximity detector 74 which would indicate initial or partial entry of the selected smoothie receptacle 30 into chiller unit 60. If no such detection takes place within a preset period of time, as act 14-7 an ERROR flag is set to indicate a jam. If, however, the selected smoothie receptacle 30 is detected within the preset period of time, the controller 40 continues to monitor, looking for activity from the chiller exit proximity detector 76 to indicate the full entry and seating of the selected smoothie receptacle 30 within chiller unit 60. If no such detection takes place within a preset period of time, an ERROR flag is set to indicate a jam (act 14-7). If, however, the selected smoothie receptacle 30 is detected as fully inserted within the preset period of time, the controller 40 continues to its next function, e.g., closing the thermal transfer members 80 (chill plates) of chiller unit 60.

Act 14-9 comprises clamping of the selected smoothie receptacle 30 in chiller unit 60, and thus involves closing of the thermal transfer members 80 (e.g., activation of actuator 100 to move chill plate 80C into contact with the smoothie receptacle 30 positioned in unit frame 64). The closing of the chill plate 80C involves the execution of the DC stepper motor of actuator 100 in the forward direction, driving the chiller plate 80C to the closed position. The closed or clamping position is detected by monitoring the motor drive current of actuator 100. If no such detection takes place within a preset period of time, an ERROR flag is set to indicate a jam. If, however, the motor stall current flag is detected as fully closed within the preset period of time, the controller 40 continues to its next function (e.g., act 14-10, agitation). To augment the detection of the chill plate motor position, an optical encoder which reliably functions in a cold and moist operating environment.

The agitation routine of act 14-10 comprises energizing of the agitation/vibration solenoid of the agitation apparatus (e.g., agitators 110). The vibration mode can occur by pulsing the drive current to the solenoids of the agitators 110 such that the solenoid piston fully extends then retracts by a longitudinal force comprising a return spring and the gravitational weight of the chiller unit 60. During the agitation of act 14-10 the controller 40 looks for a status change clock stream from vibration sensor/detector 79 which validates agitation excursion. If no such detection takes place within a preset period of time and or during the preset agitation period, an ERROR flag is set to indicate a jam. If, however, the agitation status signal is normal, the agitation function is continued until terminated at a preset period of time, after which the receptacle delivery routine of act 14-11 is commenced.

The receptacle delivery routine of act 14-11 comprising disabling the agitation routine of act 14-10 to prevent damage to receptacle retention/release solenoid 66. The receptacle delivery routine of act 14-11 then performs further subacts such as the following: enabling the receptacle retention/release solenoid 66; re-enabling the agitation routine of act 14-10; moving the thermal transfer members 80 out of contact with the selected smoothie receptacle 30 (e.g., reversing the motion of chill plate 80C so that chill plate 80C backs away from the selected smoothie receptacle 30 in unit frame 64); monitoring the can entry and exit proximity detector outputs (e.g., the output signals of receptacle entry detector 74 and receptacle exit detector 76). If any of the above functions fail to properly execute, the controller 40 remains in the receptacle delivery mode of act 14-11 until a preset period of time expires or the smoothie can clears the can entry sensor. If the selected smoothie receptacle 30 fails to exit from the smoothie receptacle 30 within the preset period of time set, an ERROR flag is set. Either upon setting of the ERROR flag or existing of the selected smoothie receptacle 30 from chiller unit 60 into discharge section 50, the controller 40 returns to the machine standby mode as indicated by act 14-4 of FIG. 14.

From the foregoing it is understood that, once the receptacle reaches its destination in chiller unit 60, a proximity sensor quickly determines that the receptacle has reached ideal location for the thermal transfer members 80 (e.g., chill plate 80C and thermal transfer members 80) to clamp the receptacle and begin the quick chill and agitation process. After a predetermined period time established by controller 40 (which depends on the formulation of the particular smoothie product being dispensed), the thermal transfer members 80 are actuated to separate and the receptacle retention/release solenoid 66 is energized to withdraw from its receptacle retention position, so that the selected smoothie receptacle 30 can freely drop into the vendor's delivery chute (e.g., discharge section 50). To prevent the processed smoothie receptacle 30 from sticking to either thermal transfer member 80, the agitators 110 can remain on (e.g., activated) until the smoothie receptacle 30 is fully released as determined by the proximity detector.

In an example implementation, the thermal transfer members 80 of chiller unit 60 comprises an extruded aluminum form with one side (e.g., receptacle contact surface 82) shaped to match the diameter of the selected smoothie receptacle 30 and the other side (e.g., module mating surface 84) is a heat surface configured to contact and retain one or more thermoelectric modules (e.g., thermoelectric cooling modules 90). In the illustrated example embodiment, there are two opposing thermal transfer members 80 or chiller plates, one stationary chiller plate 82S and one clamping chiller plate 82C that closes (by action of actuator 100 such as a linear motor) upon the selected smoothie receptacle 30 reaching full insertion. The thermal transfer members 80 or chiller plates are optimally sized to provide maximum contact area for the selected smoothie receptacle 30, while minimizing clamping distance for the selected smoothie receptacle 30, which reduces overall cycle time. The chiller plate heat sinks in the form of finned heat exchangers 92 provide a means of removing heat created from the thermoelectric chips from the thermal transfer members 80 (chiller plates) in performing a heat pump function.

Figure 15:
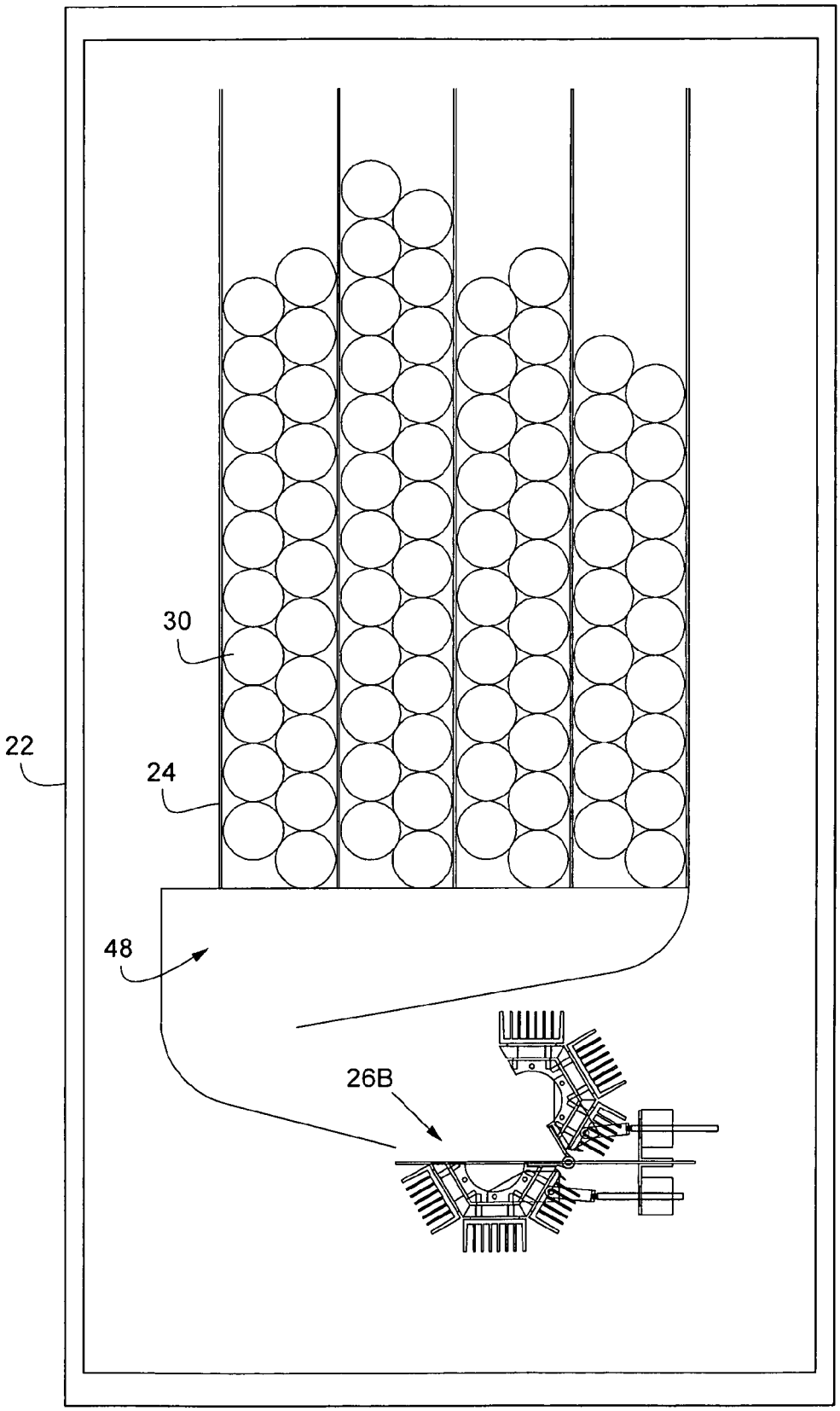
FIG. 15 is a schematic front view of internal portions of a smoothie dispenser according to another example embodiment.

FIG. 15 illustrates portions of a smoothie dispenser according to an example embodiment, and particularly portions of smoothie receptacle storage section 24 and receptacle conformed chiller section 26B according to the example embodiment. Other than the configuration of the receptacle conformed chiller section 26B, the smoothie dispenser shown in FIG. 15 can resemble smoothie dispenser 20 of FIG. 1. For this reason, only selected constituent elements of the smoothie dispenser are illustrated in FIG. 15, and those elements are illustrated for giving a sense of placement context of the chiller section 26B. For example, FIG. 15 shows the frame 22, smoothie receptacle storage section 24, and receptacle drop chute 48 of the smoothie dispenser of FIG. 15, so that it can be seen how a smoothie receptacle 30 enters the chiller section 26B.

Figure 16A:
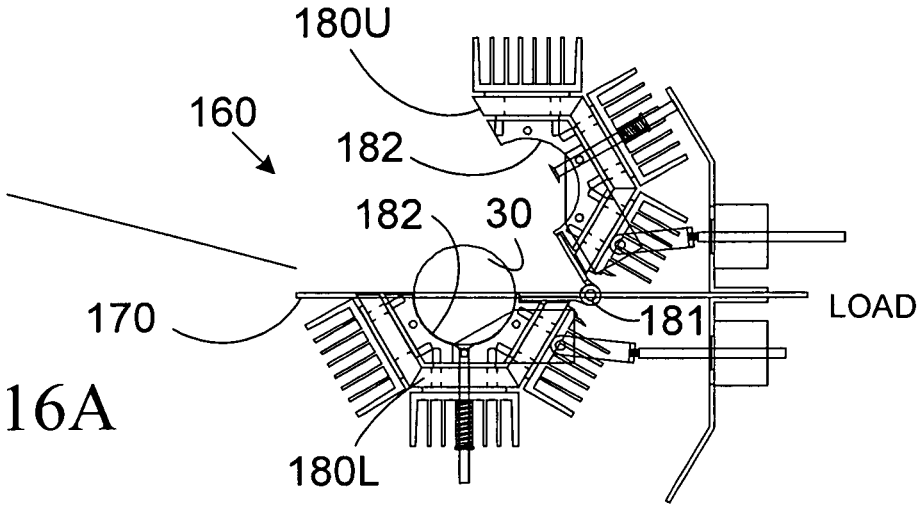
FIG. 16A is a schematic side view of a chiller unit of the smoothie dispenser embodiment of FIG. 15 showing a chiller unit core in an load position.
Figure 16B:
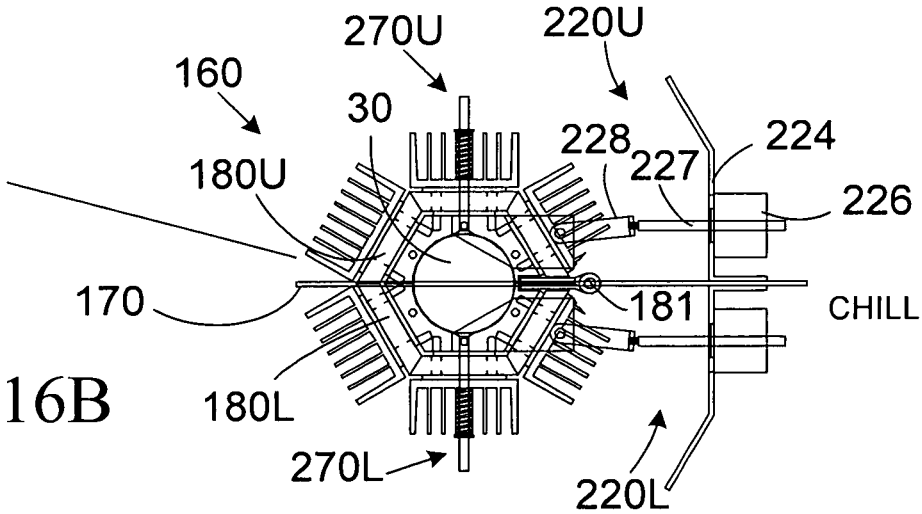
FIG. 16B is a schematic side view of a chiller unit of the smoothie dispenser embodiment of FIG. 15 showing a chiller unit core in a chill position.
Figure 16C:
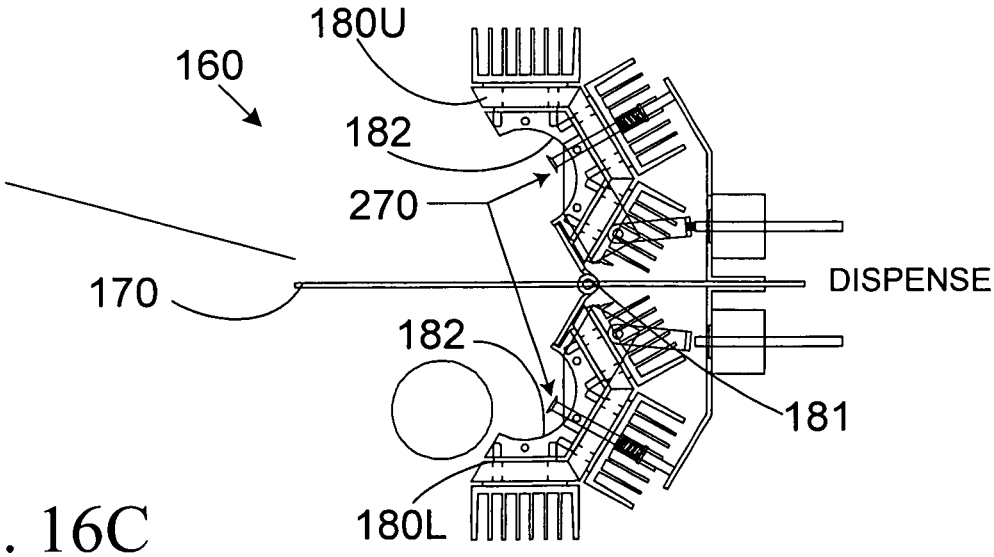
FIG. 16C is a schematic side view of a chiller unit of the smoothie dispenser embodiment of FIG. 15 showing a chiller unit core in a dispense position.

FIG. 16A-FIG. 16C show more details of certain structural aspects of chiller section 26B, and in addition show three stages of operation of chiller section 26B. FIG. 16A shows a loading stage of operation of chiller section 26B; FIG. 16B shows a chilling or cooling stage of operation of chiller section 26B; and FIG. 16C shows a discharge stage of operation of chiller section 26B.

The chiller section 26B of the embodiment of FIG. 15 comprises a chiller unit 160 or chiller "core". The chiller unit 160 comprises chiller mounting plate 170 to which two thermal transfer members 180 are hingedly mounted about hinge rod 181. As shown in FIG. 15 the thermal transfer members 180 include upper thermal transfer member 180U (also known as a core upper shell) and lower thermal transfer member 180U (also known as a core lower shell). In the embodiment of FIG. 15, both thermal transfer members 180 are capable of motion, e.g., pivoting motion about hinge rod 181. The upper transfer member 180U is pivotally mounted on a first or upper side of mounting plate 170; the lower transfer member 180L is pivotally mounted a second or lower side of mounting plate 170.

Figure 18A:
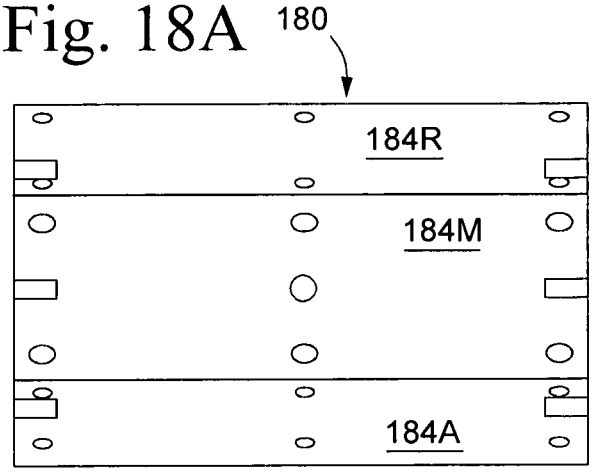
FIG. 18A is a top view of a core shell member for a chiller unit core of the smoothie dispenser embodiment of FIG. 15.
Figure 18B:
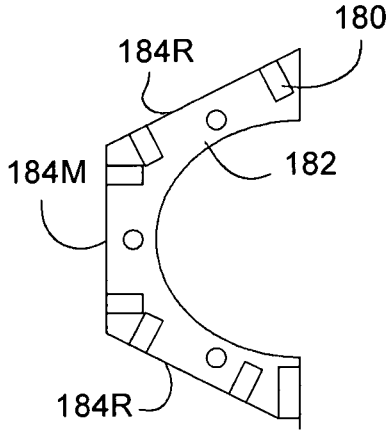
FIG. 18B is a side view of the core shell member of FIG. 18A.

The thermal transfer members 180 each have an arcuate receptacle contact surface 182. As in the previous embodiment, the receptacle contact surface can (for example) be configured to conform to at least a portion of a semi-cylindrical sidewall of a can or bottle, such as a standard aluminum soda can. In contrast to the thermal transfer members of the first embodiment, the thermal transfer members 180 have plural module mating surfaces 184, e.g., plural non-coplanar surfaces which are opposite to the receptacle contact surface 182. For example, and as shown in FIG. 18A and FIG. 18B, in the illustrated embodiment the thermal transfer members 180 have three module mating surfaces 184, including a hinge-adjacent module mating surface 184A, a middle module mating surface 184M, and a hinge-remote module mating surface 184R. The surfaces of the thermal transfer members 180 (e.g., adjacent module mating surface 184A, a middle module mating surface 184M, and a hinge-remote module mating surface 184R) are each essentially flat surfaces upon which respective thermoelectric cooling modules 190 are mounted.

FIG. 27 shows a sectioned view of a portion of a thermal transfer member 180, and specifically a stacked arrangement of elements provided on each module mating surface 184. Although only one module mating surface 184 is shown in FIG. 27, it will be appreciated that a similar stacked arrangement occurs for each of the plural module mating surfaces 184 of a thermal transfer members 180, including adjacent module mating surface 184A, a middle module mating surface 184M, and a hinge-remote module mating surface 184R. The stacked arrangement of elements comprises a first layer of thermoelectric cooling modules 190, with the first layer of thermoelectric cooling modules 190 being sandwiched between the module mating surface 184 and a transfer plate 194. The transfer plate 194 is wedged at each end to accommodate arrangement and placement of plural transfer plates 194 around the respective plural module mating surfaces 184. A first flat surface of each transfer plate 194 contacts an underlying thermoelectric cooling module 190 of the first layer of modules, an opposed flat surface of each transfer plate 194 contacts an overlying thermoelectric cooling module 196 of a second layer of thermoelectric cooling module modules. The thermoelectric cooling modules 196 of the second layer are sandwiched between the transfer plate 194 and a finned heat exchanger, the finned heat exchanger comprising heat exchanger base plate 198 and heat exchanger fins 200. The heat exchanger fins 200, in the illustrated embodiment, extend essentially orthogonally from the heat exchanger base plate 198 upon which they are mounted. In an example embodiment, the stacked arrangement can be secured together by fasteners 202 which extend through various members of the stack and anchor into thermal transfer member 180.

In an example embodiment, the thermoelectric cooling module are essentially square, and each layer actually consists of two modules placed nearly end to end, providing maximum surface area relative to the oblong can shape. Thus, for a two-layer, six-sided chiller core, the total number of thermoelectric cooling modules is twenty four.

Figure 19A:
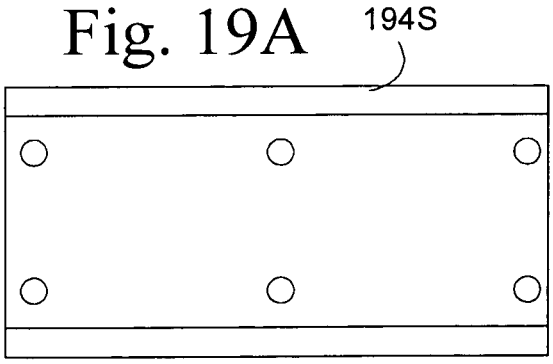
FIG. 19A is a top view of a standard transfer plate for a chiller unit core of the smoothie dispenser embodiment of FIG. 15.
Figure 19B:
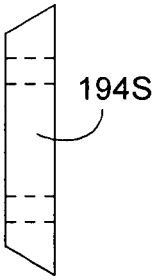
FIG. 19B is a side view of the standard transfer plate of FIG. 19A.
Figure 20A:
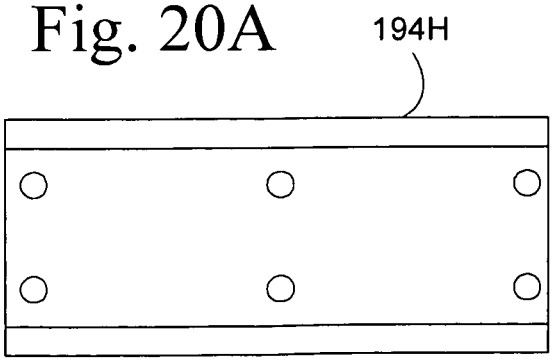
FIG. 20A is a top view of a hinge side transfer plate for a chiller unit core of the smoothie dispenser embodiment of FIG. 15.
Figure 20B:
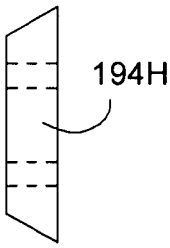
FIG. 20B is a side view of the hinge side transfer plate of FIG. 20A.

The transfer plates which overlie the middle module mating surface 184M and the remote hinge-remote module mating surface 184R are known as standard transfer plates 194S and have essentially the same shape, size, and configuration, a representative such standard transfer plate 194S being shown in FIG. 19A and FIG. 19B. On the other hand, the transfer plates which overlie the hinge adjacent module mating surface 184A is known as hinge side transfer plates 194H, and has a smaller width dimension that the standard transfer plate 194S (a representative such hinge side transfer plate 194H being shown in FIG. 20A and FIG. 20B).

FIG. 24A and FIG. 24B show further the finned heat exchanger comprising heat exchanger base plate 198 and heat exchanger fins 200, and particularly a standard size finned heat exchanger suitable for positioning over the middle module mating surface 184M and the hinge-remote module mating surface 184R. By contrast, FIG. 25A and FIG. 25B show a truncated finned heat exchanger comprising heat exchanger base plate 198' and heat exchanger fins 200' suitable for positioning over the adjacent module mating surface 184A, with FIG. 25A and FIG. 25B particularly showing removal of selected fins near the hinge rod 181 to facilitate hinging of the thermal transfer members 180 for opening and closing the thermal transfer members 180 about the selected smoothie receptacle 30.

The second layer of thermoelectric cooling modules 196 comprise thermoelectric cooling modules which serve as auxiliary thermal transfer members and the transfer plates 194 serve as auxiliary thermal transfer members. Thus, in the FIG. 15 embodiment, an auxiliary thermoelectric cooling module 196 is connected between the auxiliary thermal transfer member 194 and the finned heat exchanger plate 198. The rate of heat transfer of a thermoelectric cooling module, in watts, is an inverse function of the temperature gradient ($\Delta T$) across the thermoelectric cooling module. At the maximum $\Delta T$ for a given device, the reverse (leakage) heat flux reaches equilibrium with the thermoelectric cooling module forward heat transfer, giving a net flux of zero. To achieve a high $\Delta T$ across the entire assembly, two thermoelectric cooling module stages are employed in the example implementation of FIG. 17A, each operating in the middle of their range. This allows the inner core to be at subzero temperatures while the heat sink is well above room temperature and provides a high rate of thermal transfer out of the core into the fan airstream.

Figure 17A:
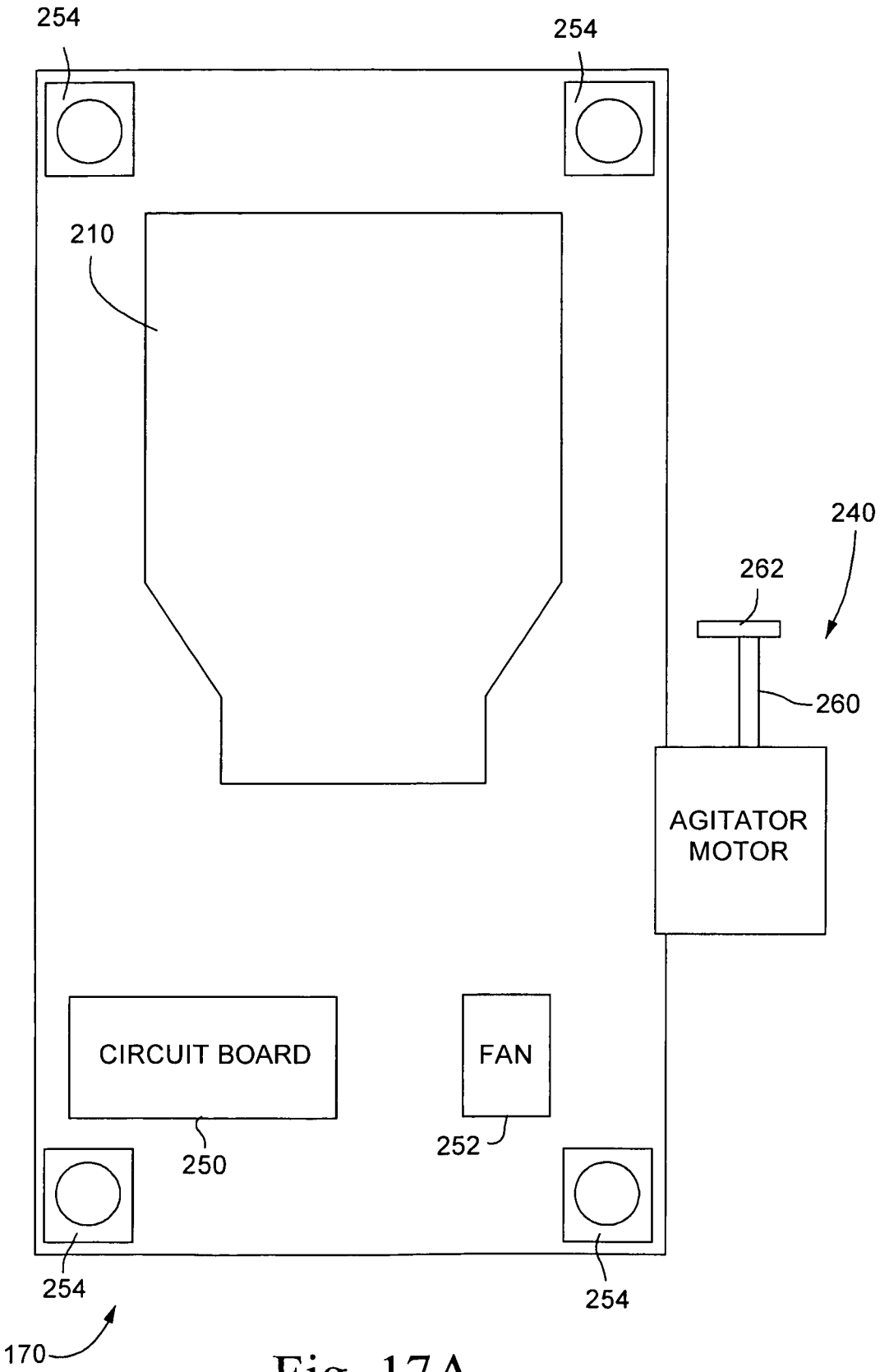
FIG. 17A is a top view of a mounting plate for a chiller unit core of the smoothie dispenser embodiment of FIG. 15.

As shown in FIG. 17A, chiller mounting plate 170 is configured with cavity 210 (e.g., an open cutout) formed therein to accommodate, e.g., the selected smoothie receptacle 30 when the smoothie receptacle 30 is clamped between the two thermal transfer members 180U and 180L. As previously explained, the thermal transfer members 180 are pivotably mounted to chiller mounting plate 170 about hinge rod 181.

In an example implementation, actuator assemblies 220 which open and close the thermal transfer members 180 are also mounted on chiller mounting plate 170 (see FIG. 16B). One actuator assembly 220U is mounted on an upper side of chiller mounting plate 170 for opening and closing upper thermal transfer member 180U, another actuator assembly 220L is mounted on a lower side of chiller mounting plate 170 for opening and closing lower thermal transfer member 180L.

Each actuator assembly 220 comprises several elements, including actuator bracket 224 which is mounted in on the respective side of chiller mounting plate 170. An actuator 226 in the form of a stepper motor is carried on the actuator bracket 224 and has rod or piston 227 which is connected to actuator yoke 228. Each end of the actuator yoke 228 is pivotally mounted to spaced apart yoke brackets 230. A base of each yoke bracket 230 is mounted on the chiller mounting plate 170. FIG. 21A-FIG. 21C show, in more detail, the actuator bracket 224 according to a first example embodiment in which the actuator bracket 224 has an essentially "L" shape. It should be understood that the actuator bracket 224 can have other shapes or configurations, such as the shape shown in FIG. 16A-FIG. 16C in which the actuator bracket 224 has an angled extension at a distal end thereof to serve as a stop for an receptacle ejector assembly. FIG. 22A-FIG. 22C show, in more detail, the actuator yoke 228; and FIG. 23 shows an example yoke bracket 230. The foregoing structure is provided in essentially mirror image on both the upper and lower surfaces of chiller mounting plate 170 for each of upper thermal transfer member 180U and lower thermal transfer member 180L, respectively.

Thus, from the foregoing it is understood that actuator motor 226 is mounted to chiller mounting plate 170 by the actuator bracket 224. The actuator shaft 226 is connected by hinged linkage to the actuator yoke 228, which in turn is attached at pivot points to the yoke brackets 230. The hinge rod 181 is mounted to chiller mounting plate 170 and passes through a hinge of the core mounted on chiller mounting plate 170. As a core half (e.g., a thermal transfer member 180) opens, the yoke bracket 230 rotates on the pivots and remains roughly parallel to chiller mounting plate 170 while the heat sink fins 200 rotate down though the yoke 228 without interference. In some implementations springs may be useful to relieve the force of gravity opposing the opening of the upper core half and opposing the closing of the lower core half.

FIG. 17A also shows that chiller mounting plate 170 can carry driver circuit board 250 which can function as or include the controller 40. If desired, driver circuit board 250 can be provided on each side of chiller mounting plate 170. The driver circuit board 250 can comprise a stepper motor driver circuit for the actuator 226. Flexible stranded power wires connect to driver circuit board(s) 250 to allow for the opening and closing of the thermal transfer members 180. The driver board 250 shown is a stepper motor driver circuit for the actuator. Placing driver board 250 on the core plate 170 reduces the number of wires that must connect from the core assembly. Flexible stranded power wires connect to driver circuit board(s) 250 to allow for the opening and closing of the thermal transfer members 180. The high-current driver boards for the thermoelectric cooling modules 196 are larger and may be located either on the driver board 250 or elsewhere (off chiller mounting plate 170).

Figure 17B:
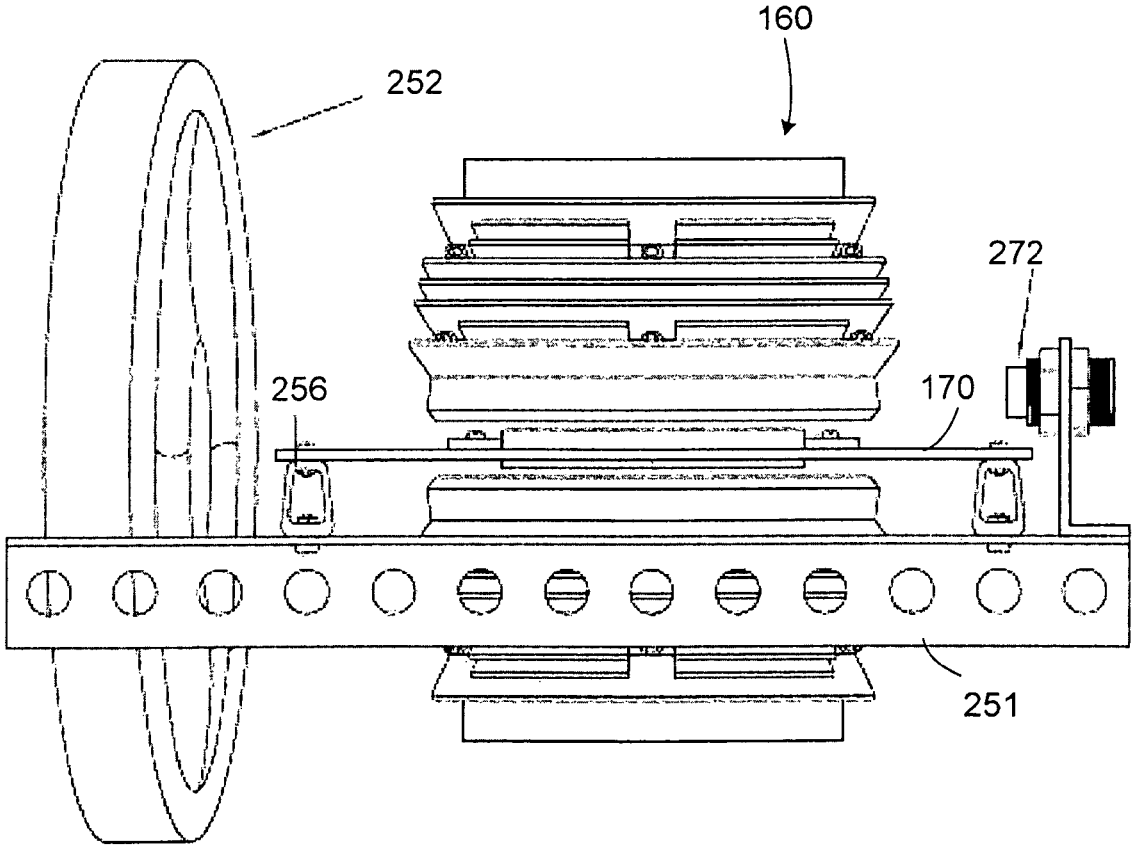
FIG. 17B is a side view of a chiller unit of the smoothie dispenser embodiment of FIG. 15 and particularly showing mounting of the chiller unit to a dispenser frame member.

In addition, as shown in a support member 251 of frame 22 of the smoothie dispenser can carry a fan or other source of airflow which is directed toward the fins of the finned heat exchangers. In this regard, FIG. 17B shows by way of non-limiting example a representative fan 252 mounted on or proximate frame support member 251.

The chiller mounting plate 170 is mounted to frame 22 of the smoothie in a resilient manner. In an example implementation illustrated in Fig. FIG. 17A and FIG. 17B, rubber isolation mounts 256 attach through holes in the four corners of the chiller core plate (e.g., chiller mounting plate 170) to a portion of frame 22. For example, the four corners of the chiller mounting plate 170 of FIG. 17A can be secured by the rubber isolation mounts 256 to an internal shelf or frame support member 251 (see FIG. 17B). The flexibility of the rubber isolation mounts 256 allows the chiller unit 160 to vibrate relative to the machine frame.

In addition, as also shown in FIG. 17A, chiller mounting plate 170 carries an agitator assembly 240. In an example embodiment, agitator assembly 240 can comprise a simple AC or DC motor mounted directly or indirectly to chiller mounting plate 170. The motor has a shaft 260 or the like that is fitted with a small flywheel 262 that is intentionally out of balance, causing an eccentric excursion of the flywheel mass. This vibration pattern is transmitted to the chiller core plate (e.g., chiller mounting plate 170) and thus to the entire core assembly. As mentioned above, the core plate is attached to the machine frame with rubber isolation mounts 256.

In one example embodiment of FIG. 15, and as shown by FIG. 16A-FIG. 16C, the chiller unit 160 further comprises a receptacle ejector assembly for each half of the chiller core, e.g., receptacle ejector assembly 270U mounted to thermal transfer member 180U and receptacle ejector assembly 270L mounted to thermal transfer member 180L. As understood from Fig. FIG. 16A-FIG. 16C (and FIG. 16B and FIG. 16C in particular) each receptacle ejector assembly 270 comprises a reciprocating plunger element which is positioned and operated to extend through the thermal transfer members 180 in the vicinity of the middle module mating surface 184M and to protrude from the receptacle contact surface 182 when operated (in the dispense phase shown in FIG. 16C) to discharge a smoothie receptacle 30 from the thermal transfer members 180. The plunger element of receptacle ejector assembly 270 can be spring-loaded like an automotive tappet valve and be depressed mechanically by the backstop at the end of the opening stroke of the chiller core halves. Thus the linear actuator motors provide the ejection force In an example implementation, the thermal transfer member is configured to accommodate the receptacle ejector at least partially within the thermal transfer member. Although not necessarily explicitly shown in other figures, other elements mounted on the thermal transfer members 180 in the vicinity of the middle module mating surface 184M are preferably provided with a cavity or other means for allowing the receptacle ejector assembly 270 to be positioned to extend through at least thermal transfer members 180 and well as through those other elements. In this regard, appropriate holes or apertures can be formed in the elements which are mounted to the thermal transfer members 180. Since there are two thermoelectric cooling modules at each layer, a separation of about 0.3 inch between them allows a 0.25" ejector shaft to pass through a hole at the center of each element of the upper and lower center stack.

The reciprocating plunger element which comprises the receptacle ejector assembly 270 can take the form of a solenoid, for example, and can be bidirectional or unidirectional, with spring or other biased assist as necessary. The operation of each receptacle ejector assembly 270 and its reciprocating plunger element is controlled, e.g., by controller 40 in time relation to the overall operation of chiller unit 160 of receptacle conformed chiller section 26B.

If desired the chiller unit 160 can also incorporate a temperature sensor 272 (see FIG. 17B) to detect temperature of the smoothie receptacle 30 in chiller unit 160. The temperature sensor can take any appropriate form, such as (for example) a non-contact IR thermocouple which employs an optoelectronic detector. The optoelectronic detector can be of a type obtained from Exergen which remote measures the infrared radiation across a defined solid angle (the read spot). To counter any measurement skewness that might result from reflective surfaces, in its area of reading the smoothie receptacle 30 may beneficially have a dark matte finish applied or painted on its metallic surface (e.g., on a bottom end).

In an example implementation, the controller 40 is configured to reverse operation of the chiller unit 160 and the thermoelectric cooling modules in particular and thereby defrost the thermal transfer members 180 for facilitating release of the selected smoothie receptacle. Whether such defrost capability is needed at any given moment may be a function of humidity and condensation in the environment where the equipment is located. Thus, the defrost cycle can optionally be included and would add no more than about 5-8 seconds to the total cycle of operation.

In an example embodiment, the smoothie dispenser 20 can require, during high-current vending demand, a power rate of about 2 kW for 60 seconds. The quiescent power consumption should be less than 30 W (for electronics) plus battery charging current. Of course, these quantities depend on factors such as the time interval between vending, etc.

From the foregoing it will be understood that the receptacle conformed chiller section 26B and its chiller unit 160 of the embodiment of FIG. 15 comprises the following non-exhaustive list of components (many of which are illustrated in FIG. 27):

- a chiller core comprising a hinged pair of aluminum inner surfaces (e.g., thermal transfer members 180) which are milled on the inside to cylindrical shape (e.g., receptacle contact surfaces 182) to match the size of the smoothie receptacle 30 and which are milled flat on the outside to form module mating surfaces 184;
- a first layer of thermoelectric devices (T.E.D.s) [e.g., in the example form of thermoelectric cooling modules 196] arranged around the chiller core and thermally bonded to the flat outer surfaces 184 of the thermal transfer members 180;
- a layer of aluminum wedges (e.g., transfer plates 194) arranged about/around the T.E.D.s; a second layer of thermoelectric devices (T.E.D.s) [e.g., in the example form of thermoelectric cooling modules 196] thermally bonded to the flat outer surfaces of the wedges 194;
- an outer layer of finned heat sinks (comprising heat exchanger base plate 198 and heat exchanger fins 200) thermally bonded to the outer T.E.D.s; and a mounting plate for the core (e.g., chiller mounting plate 170) which comprises an opening 172 to permit swing operation of the chiller core halves, and rubber isolation mounts 256.

Other components of the smoothie dispenser of the embodiment of FIG. 15 and other embodiments include but are not limited to the following:

- an axial cooling fan (e.g., fan 252) located at one end of the chiller core (e.g., on chiller mounting plate 170) and having sufficient diameter to provide air flow over the heat sink fins (e.g., heat exchanger fins 200);
- two stepper motors (e.g., actuators 226) with captive linear actuator screws, linked to the two hinged halves of the chiller core to open and close the two hinged halves of the chiller core on command;
- an electric motor (e.g., comprising agitator assembly 240) mounted to the chiller core plate (e.g., chiller mounting plate 170), having an eccentrically weighted wheel 262 on its shaft 260, to provide vibration of the chiller core assembly;

a non-contact infrared thermocouple aligned with the bottom end of the subject aluminum can, to provide temperature monitoring;

circuit board(s) (e.g., circuit board 250) providing interconnection of the thermoelectric cooling modules (T.E.D.s) and feed point for power, and which can include two H-bridge stepper motor controller circuit boards for the linear actuators (e.g., actuators 226) and two high-current H-bridge circuit modules allowing reversible current, pulse-width-modulated power feed to the thermoelectric cooling modules (T.E.D.s);

DC power supplies (such as power supply 42 of FIG. 1) for the thermoelectric cooling modules (T.E.D.s), stepper and vibration motors.

Figure 28:
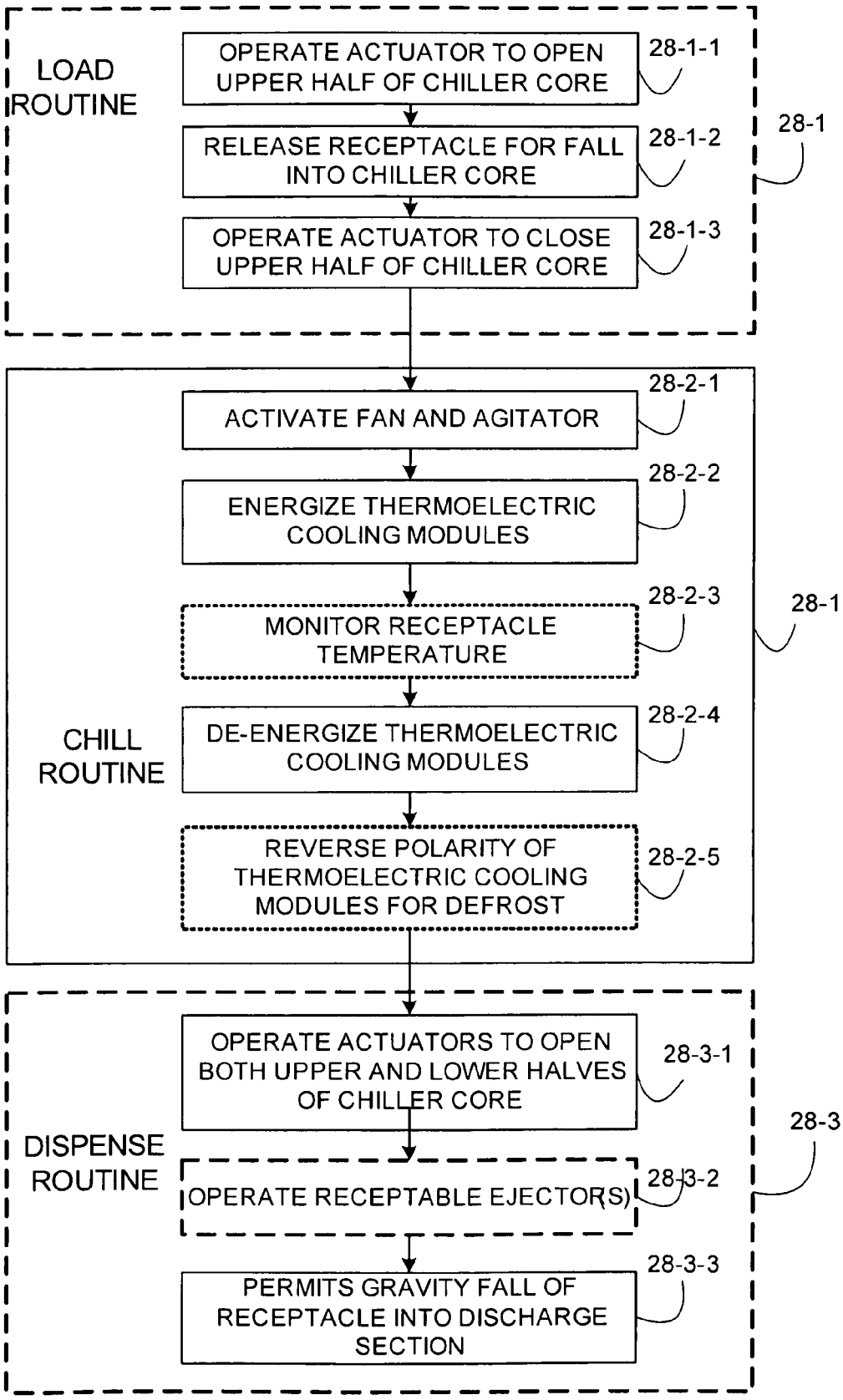
FIG. 28 is a flowchart showing basic acts or steps involved in a method of operation of another example embodiment smoothie dispenser.

Basic, representative acts or steps involved in operation of example embodiments of smoothie dispensers described herein including but not limited to the embodiment of FIG. 15 are shown in FIG. 28. FIG. 28 shows various phases or routines of operation, including loading routine 28-1; chilling routine 28-2; and dispensing routine 28-3.

Loading routine 28-1 is illustrated in FIG. 16A and comprises subact 28-1-1 through subact 28-1-3. As subact 28-1-1 the controller directs the actuator 226 for the upper thermal transfer member 180U to open the upper half of the core. In so doing, the upper thermal transfer member 180U pivots about hinge rod 181. As subact 28-1-2 the selected smoothie receptacle 30 is released from the smoothie receptacle storage section 24 so that it falls by gravity through receptacle drop chute 48 and ultimately into the cavity 210 formed in chiller mounting plate 170. As 28-1-3 the controller 40 directs the actuator 226 for the upper thermal transfer members 180U to close the upper half of the core, so that the selected smoothie receptacle 30 is now essentially completely circumferentially surrounded by the thermal transfer member 180U and the thermal transfer member 180L.

Chilling routine 28-2 is depicted in FIG. 16B and comprises one or more of subact 28-2-1 through subact 28-1-2. As subact 28-2-1 the controller 40 turns on the fan 252 and agitator assembly 240. As subact 28-2-2 the controller 40 energizes the inner and outer layers of the thermoelectric cooling modules, e.g., thermoelectric cooling modules 190 and thermoelectric cooling modules 196. In an example implementation, this can be done by applying pulse-width-modulated DC voltage through high-current H-bridge circuits; with a duty cycle for inner and outer layers which provides optimum $\Delta T$ at each cooling module for the required cooling rate.

As optional subact 28-3, the controller 40 uses temperature sensor 272 (in the form of, e.g., a non-contact IR thermocouple device aimed at end of the smoothie receptacle 30) to monitor temperature of the smoothie receptacle 30 (the receptacles can have a matte painted end for proper reading). An example position for temperature sensor 272 is shown in FIG. 17B.

As subact 28-2-4, the controller 40 terminates chill cycle either upon reaching a desired predetermined temperature or upon other criteria, such as expiration of time (for example). To terminate the chill cycle, the controller 40 terminates the signal (e.g., voltage) applied to the inner and outer layers of the thermoelectric cooling modules, e.g., thermoelectric cooling modules 190 and thermoelectric cooling modules 196.

As optional subact 28-2-5, if required the controller 40 may reverse polarity of the thermoelectric cooling modules momentarily to defrost the aluminum core where frost may have caused adhesion to the smoothie receptacle 30

Dispense routine 28-3 is depicted in FIG. 16C and comprises one or more of subact 28-3-1 through subact 28-3-2. As subact 28-3-1 the controller 40 directs the actuators 226 for both the upper thermal transfer member 180U and the lower thermal transfer member 180L to retract their pistons so that both upper and lower core halves of the chiller unit 160 pivot about hinge rod 181 into the open position shown in FIG. 16C. As an optional subact 28-3-2, the controller 40 can also direct one or both of the receptacle ejector assemblies 270 to extend their plungers to eject the smoothie receptacle 30 from the receptacle contact surfaces 182, thereby assisting discharge. In an example embodiment, the spring-loaded ejector can contact a backstop provided on the actuator bracket 224 and push the 30 out of either core half. As subact 28-3-3 the selected smoothie receptacle 30 is gravity-fed into the vending opening, e.g., into discharge section 50, where it can be manually obtained by the customer/consumer/patron.

Figure 29:
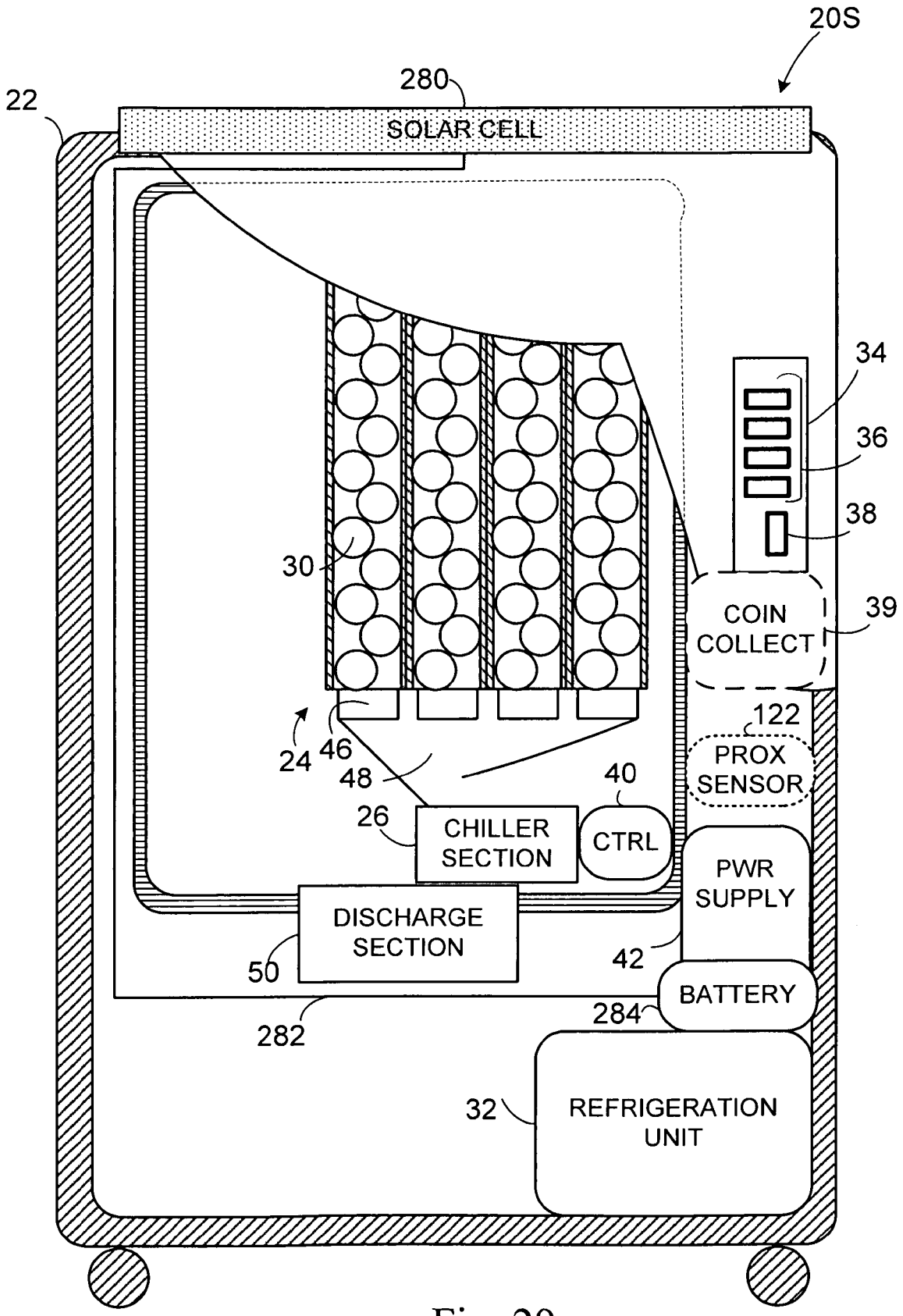
FIG. 29 is a front, partially sectioned view of a smoothie dispenser according to another example embodiment, and particularly an example embodiment which has an electromagnetic radiation collection/conversion panel (e.g., solar cell) and/or energy management features.

The smoothie dispenser 20S of FIG. 29 resembles the smoothie dispenser of FIG. 1, and as such can have any of the types of chiller sections described herein or encompassed hereby. The smoothie dispenser 20S of FIG. 29 additionally has electromagnetic radiation collection/conversion cell panel 280 (e.g., radiation collection/conversion panel such as a solar cell panel) provided on an exterior of frame 22. The electromagnetic radiation collection/conversion panel 280 can be mounted to or at least partially embedded in one or more of any members of frame 22, such as a top panel (as shown in FIG. 29) and/or side panel of frame 22. The electromagnetic radiation collection/conversion panel 280 is connected by suitable electrical connector(s) 282 to appropriate circuitry including, for example, battery 284, which can comprise or function in conjunction with power supply 42.

Figure 30:
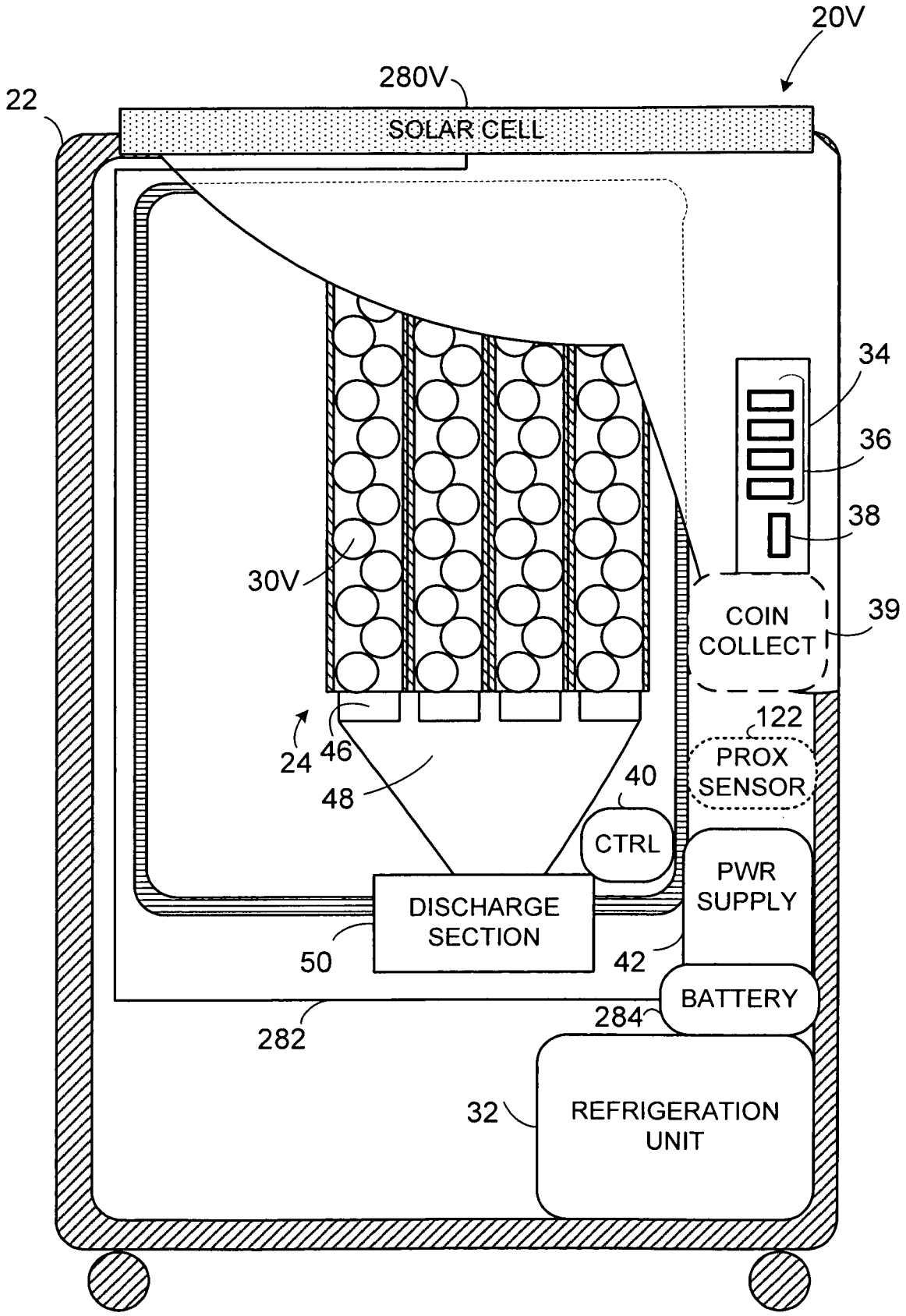
FIG. 30 is a front, partially sectioned view of an example embodiment of a generic vending machine which has solar cell and/or energy management features.

In one of its aspects the technology disclosed herein encompasses not only employment of one or more electromagnetic radiation collection/conversion panels or elements for a smoothie dispenser such as shown in FIG. 29, but for any vending machine having electrical requirements such as refrigeration, for example. To this end FIG. 30 shows an example embodiment of a generic vending machine 20V which can be used to dispense any appropriate merchandise, such as food or beverage, for example. In FIG. 30 the merchandise is shown as packaged in merchandise receptacle 30V. In much the manner understood from FIG. 29, the generic vending machine 20V has electromagnetic radiation collection/conversion panel(s) 280V provided on an exterior of frame 22. The electromagnetic radiation collection/conversion panel(s) 280V can be mounted to or at least partially embedded in one or more of any members of frame 22, such as a top panel (as shown in FIG. 29) and/or side panel of frame 22. The electromagnetic radiation collection/conversion panel 280 is connected by suitable electrical connector(s) 282 to appropriate circuitry including, for example, battery 284, which can comprise or function in conjunction with an electrical system and/or power supply 42.

Moreover, as a "green" environmental friendly feature, the smoothie dispenser 20S and/or the generic vending machine 20V may conserve power when not in use by shutting down any component which does not need electrical power when in a standby state. When a consumer/user wishes to operate the smoothie dispenser 20 or the generic vending machine 20V, the electrical system comprising power supply 42 can revert from a standby state to an operational state either automatically or by operation of a user selected switch. The electrical system can be placed into its standby, power saving, mode either automatically (for example after a predetermined time of inactivity) or by operation of a user selected switch.

Figure 31:
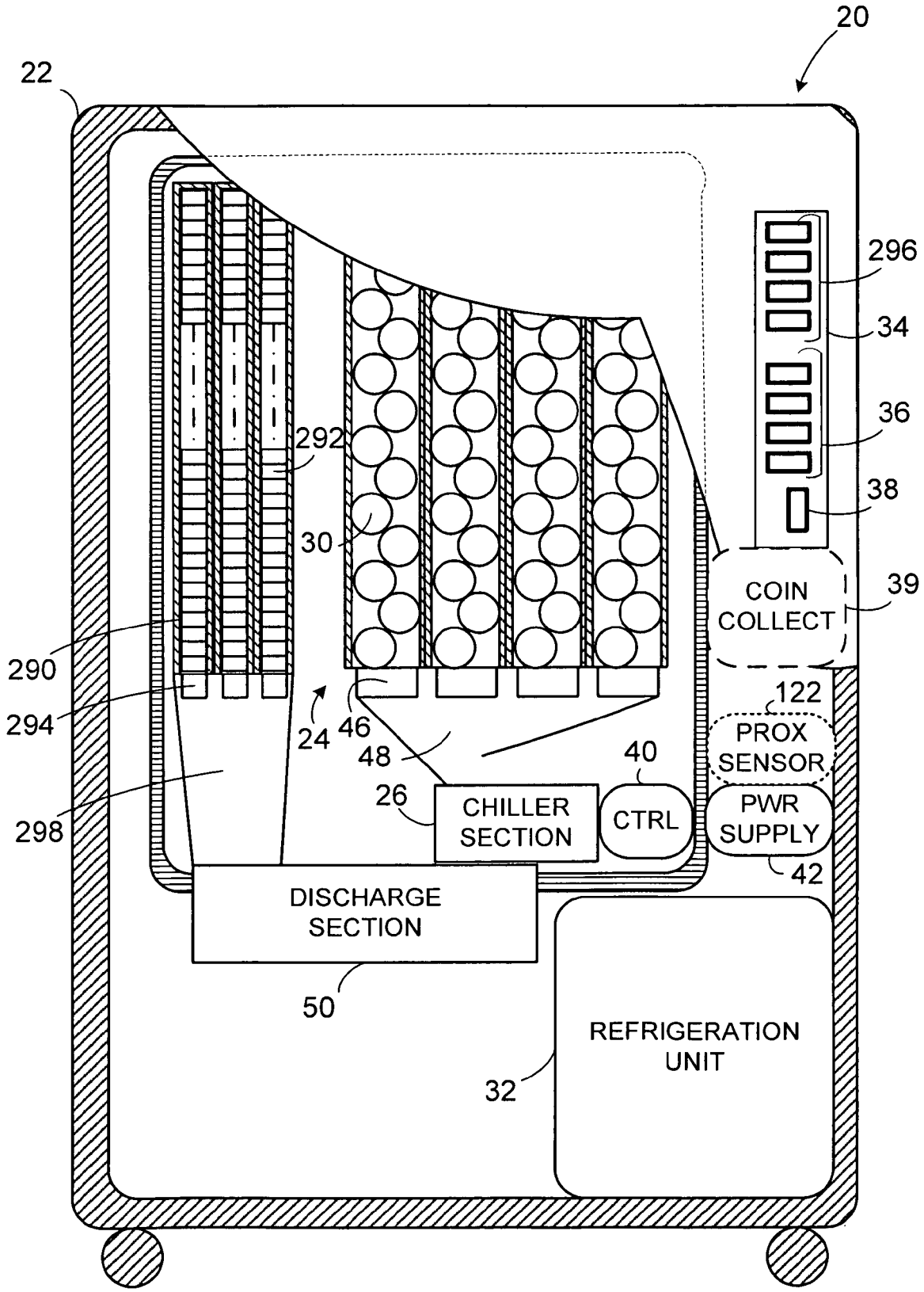
FIG. 31 is a front, partially sectioned view of a smoothie dispenser according to another example embodiment, and particularly an example embodiment which has smoothie composition additive or supplement capabilities.

The smoothie dispenser 20A of FIG. 31 resembles the smoothie dispenser of FIG. 1, and as such can have any of the types of chiller sections described herein or encompassed hereby. The smoothie dispenser 20A of FIG. 31 additionally has smoothie additive storage section 290 provided within frame 22 and configured to house a smoothie additive. The smoothie additive can take the form of a nutrition or flavor supplement, such as vitamin, herbal extract, or health supplement, for example. The smoothie additive can be in powered form or any other form suitable for rapid assimilation into the ice crystal texture of the smoothie. In the illustrated, example embodiment of FIG. 31, the smoothie additive is enveloped in additive packages 292 which are stored in appropriate bins of the smoothie additive storage section 290. In like manner as smoothie receptacle storage section 24, the bins of smoothie additive storage section 290 each have an appropriate package release mechanism 294.

As mentioned in conjunction with the embodiment of FIG. 1, the consumer-operated product selection unit 34 is provided on frame 22 and is configured to receive customer input for specifying choice of a selected smoothie receptacle. For the example embodiment of FIG. 31, the consumer-operated product selection unit 34 is augmented with a bank of additive selectors 296. The additive discharge mechanism is configured, upon actuation of a selected one of the selectors 296 (and optionally insertion of additional currency) to discharge from the frame the selected smoothie additive in coordination with discharge of the chilled selected smoothie receptacle. To this end, frame 22 further includes additive discharge chute 298 positioned beneath smoothie additive storage section 290 and through which the additive packages 292 fall by gravity into discharge section 50.

In an example embodiment, the consumer-operated product selection unit is configured to receive consumer input for optionally selecting the smoothie additive. In an example embodiment, the consumer-operated product selection unit is further configured to receive customer input for selecting one of plural possible types of smoothie additives, and wherein the smoothie additive storage section is configured to and house the plural possible types of smoothie additives.

In one of its aspects the technology disclosed herein encompasses a generic vending machine which comprises an inventory remote reporting capability. To this end, the vending machine 20N of the example, non-limiting embodiment of FIG. 32 resembles in some respects the vending machines/dispensers herein described as comprising (for example) a frame 22, receptacle storage section 24N; consumer-operated product selection unit 34; payment receipt mechanism 38; controller 40; and power supply 42. Since vending machine 20N is a generic machine, vending machine 20N can be used to dispense any appropriate merchandise, such as food or beverage, for example. Therefore, depending on the type of merchandise or product dispensed, the vending machine 20N may or may not include a refrigeration unit.

Figure 32:
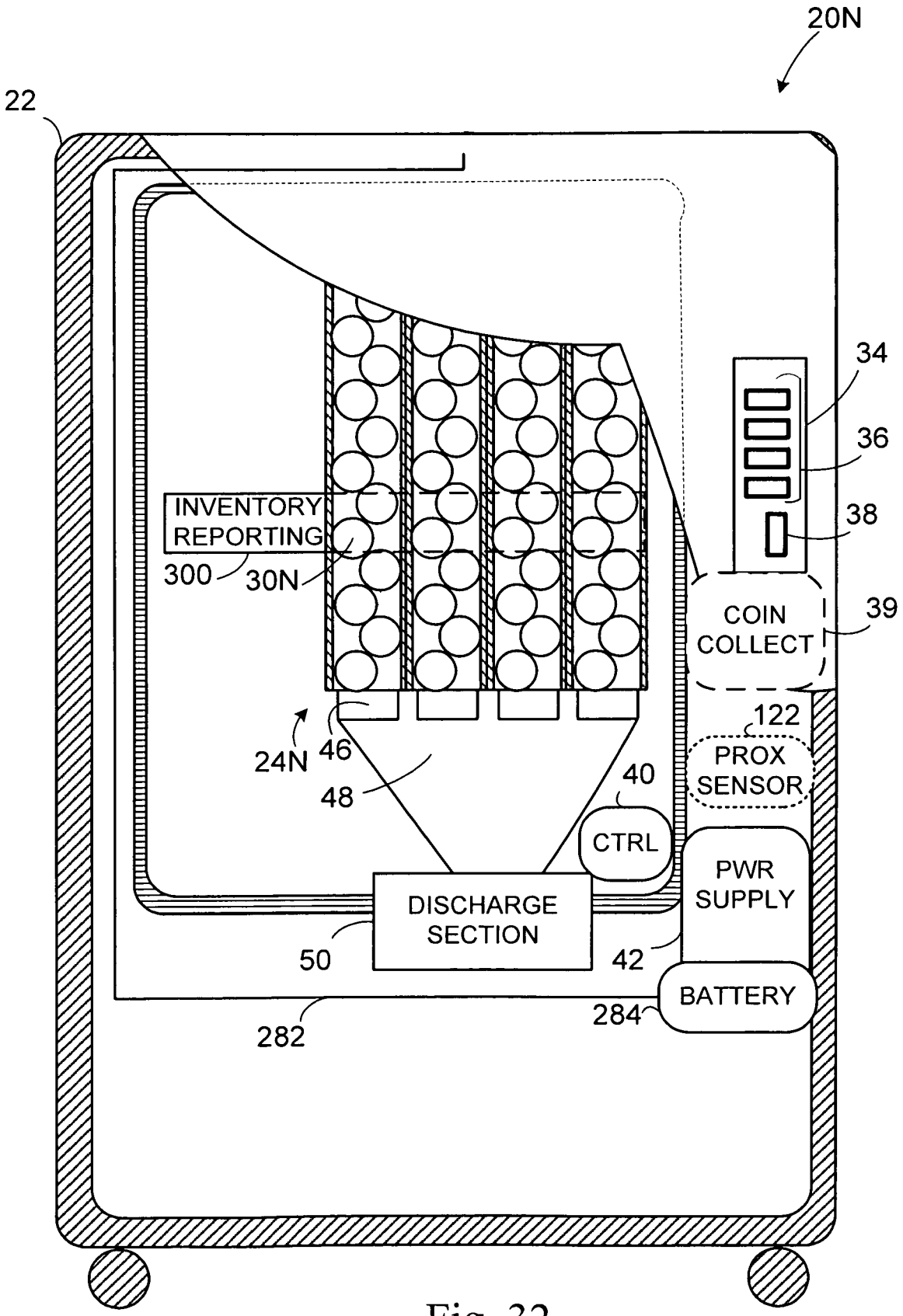
FIG. 32 is a front, partially sectioned view of an example embodiment of a generic vending machine which has a remote inventory reporting capability.
Figure 33:
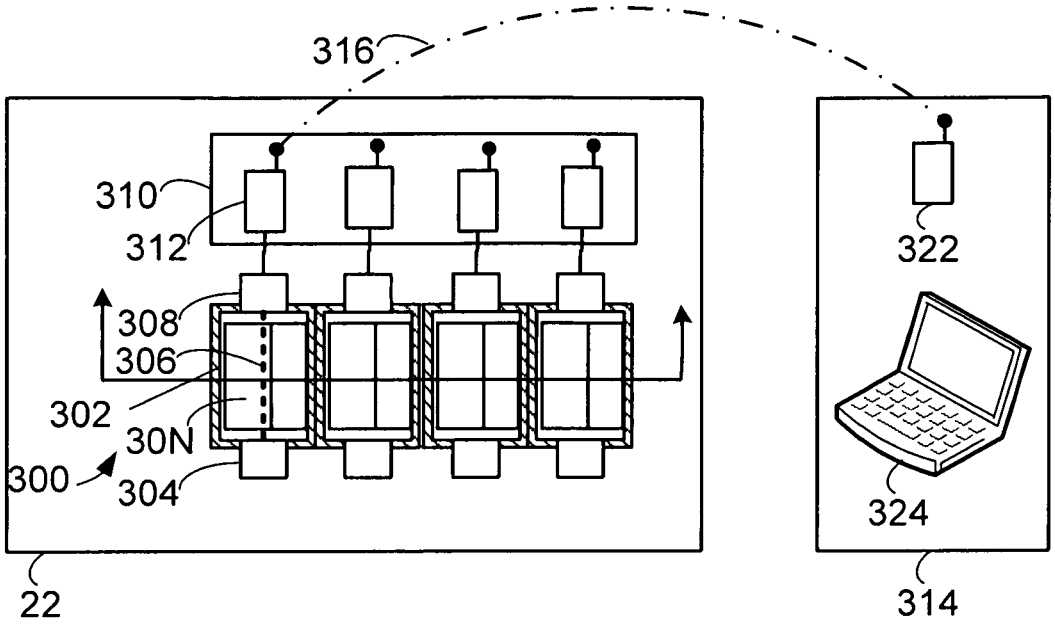
FIG. 33 is a top view of a portion of the vending machine of FIG. 32.
Figure 34:
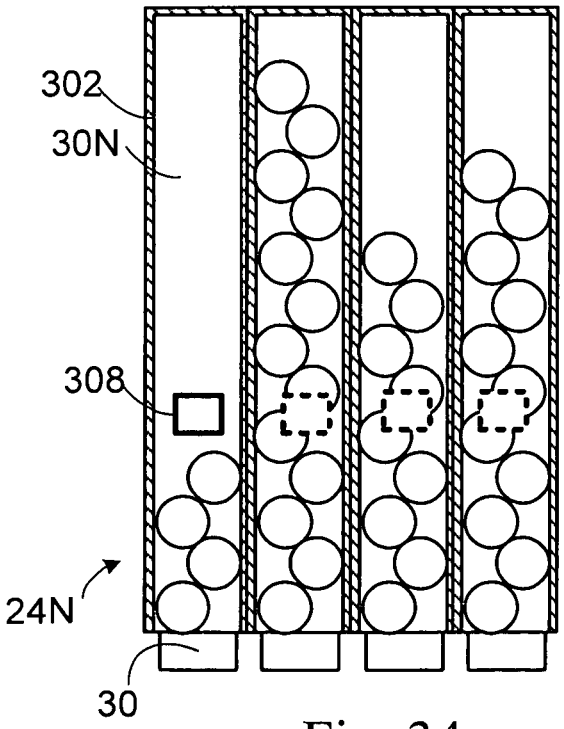
FIG. 34 is a front view taken along line N-N of FIG. 33.

The vending machine 20N of the example embodiment of FIG. 32 further comprises inventory remote reporting system 300. FIG. 33 and FIG. 34 illustrate inventory remote reporting system 300 in the context of receptacle storage section 24N. As previously explained, the receptacle storage section 24N can comprise plural bins 302. In the illustrated example, four such bins 302 arranged as a vertical column are shown in FIG. 34. The number of bins 302 may be less or more, and their configuration and orientation can vary according to internal design of the frame 22. As also previously explained, each bin can be stocked with a different brand or type of merchandise. To reflect the generic nature of the merchandise loaded into the bins 302, the receptacles thereof are denoted in FIG. 32-FIG. 34 as receptacle 30N. Each bin 302 has, at a lowermost or discharge end thereof, receptacle release mechanism 46.

Example constituents of inventory remote reporting system 300 are further illustrated in FIG. 33 and FIG. 34 as comprising an inventory sensor assembly for each bin 302. In the particular example implementation shown in FIG. 33 and FIG. 34, the inventory sensor assembly for each bin 302 comprises beam emitter 304 which emits an electromagnetic beam 306 toward beam detector 308. The beam 306 is directed by emitter 304 to traverse horizontally across the bin 302 along a path that would be occupied by a receptacle 30N if the bin 302 is sufficiently filled with inventory. FIG. 34 particularly shows that the position of emitter 306 and detector 308 are chosen so that the vertical level of beam 306 is at a position which shows near depletion of inventory, or at least a level of inventory that warrants notification for restocking of the bin 302. In other words, the emitter 304 and detector 308 are so positioned that receipt of beam 306 by detector 308 causes detector 308 to produce a signal or impulse that reflects the fact that inventory of receptacles 30 no longer blocks beam 308, thereby indicating that replenishment of inventory should be prompted.

FIG. 33 shows that inventory remote reporting system 300 further comprises inventory communication unit 310. In the illustrated embodiment, inventory communication unit 310 comprises wireless communication unit 312 which can take the form of a cell phone, user equipment unit, mobile station, or computer or the like with mobile termination. The wireless communication unit 312 is connected to receive a signal from inventory detector 308. Whenever a detector 308 detects a predetermined low inventory supply, a signal or impulse is applied to wireless communication unit 312. In response to such signal or impulse, wireless communication unit 312 sends a message to central inventory control unit 314, as indicated by dot-dashed arrow 316 in FIG. 33. The message can be received by any suitable receiver at central inventory control unit 314, such as wireless communication unit 322 or a computer 324 which either has mobile termination or is connected to receive a wireless message that has been converted to an internet or other suitable protocol message, for example. The message depicted by arrow 316 can serve to notify the inventory control unit 314 and its attendant that the inventory of a particular brand or flavor of merchandise in vending machine 20N is low.

For example, when the inventory of any particular bin is low, in an example implementation the wireless communication unit 312 associated therewith can send a pre-programmed text message to a pre-programmed telephone number stored at the communication unit 312. The central station 314 will then be notified as to which specific bin is low on supply. Alternatively, the wireless communication unit 312 can send an email to a pre-programmed email or internet address to notify of the low supply.

It should be understood that the inventory remote reporting system 300 may take different forms and have different constituent elements. For example, rather than using a beam which traverses the bin 302 when there is insufficient inventory, the detector can instead be a reflective type of detector that is positioned at one side of the bin and detects reflection of its beam back on itself when a receptacle is at the focal point of the beam. Nor need the sensor to be electro-optical, as a mechanical sensor which senses presence of a vended container at a predetermined level can also be employed. As another example, a single wireless communication unit need not be dedicated to each bin, as in other embodiments it is possible that plural bins may share the same wireless communication unit, and the wireless communication unit be programmed or activate to send a signal which differentiates between the contents of the different bins so that it may be clearly indicated which particular bin is in need of restocking.

Figure 35:
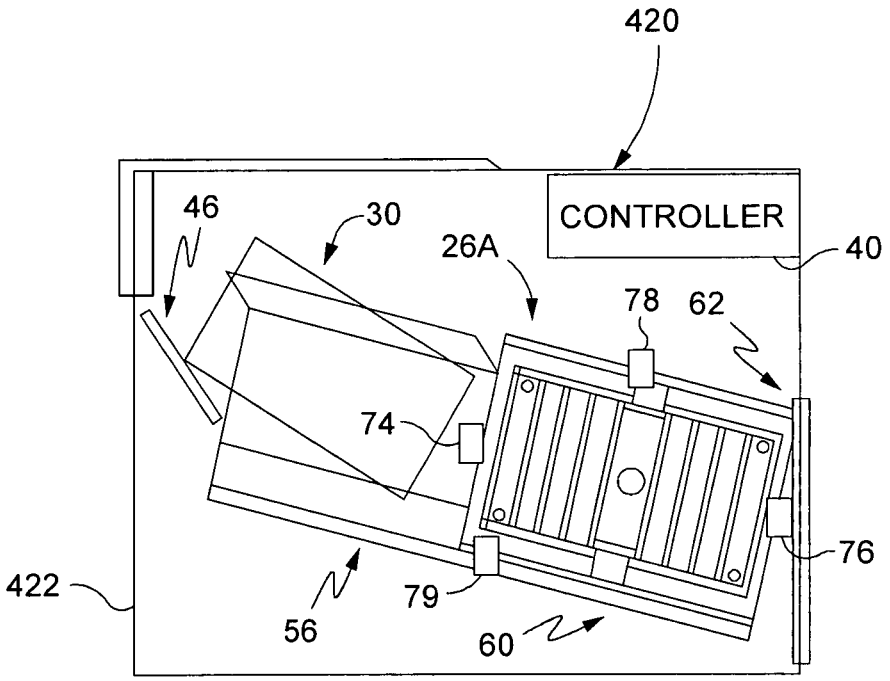
FIG. 35 is a front, partially sectioned view showing an example embodiment of a smoothie chiller unit which can be sold or installed as a separate unit for use in a dispenser or vending machine, or which can stand alone as a separate chilling unit for chilling smoothie receptacles individually placed therein.

In another of its aspects, the technology disclosed herein concerns a smoothie chiller unit which can be sold or installed as a separate unit for use in a dispenser or vending machine, or which can stand alone as a separate chilling unit for chilling smoothie receptacles individually placed therein. For example, FIG. 35 illustrates an example embodiment of smoothie chiller unit 420 which is modularized within housing 422. The smoothie chiller unit 420 is understood by reference to chiller unit 60 of FIG. 2, and can serve (with or without its housing 422) as an interchangeable component for a smoothie dispenser such as that of FIG. 1 and FIG. 2. Alternatively, smoothie chiller unit 420 can stand alone in its own housing 422 as a separate appliance. As a separate, stand alone appliance the housing 422 can be sized in some example embodiments for placement on a counter top or similar surface, and accordingly can acquire an appropriate size and footprint such as that of a conventional microwave oven, for example.

The structure and operation of the smoothie chiller unit 420 is similar to that of the embodiment of FIG. 2 as previously described, and thus comprises constituent elements similarly numbered to the foregoing embodiments. Smoothie chiller unit 420 thus comprises a thermal transfer assembly and an agitator. The thermal transfer assembly is configured to lower temperature contents of a smoothie receptacle for crystallizing the contents of the smoothie receptacle. The thermal transfer assembly comprises a thermal transfer member comprising a receptacle contact surface configured to conform to at least a portion an exterior profile of the smoothie receptacle and a thermal transfer surface; and, cooler coupled to the thermal transfer surface. The agitator is configured to agitate the thermal transfer assembly during lowering of the crystallizing of the contents of the smoothie receptacle. In a non-limiting example implementation, the thermal transfer assembly comprises two thermal transfer members and an actuator configured to move the two thermal transfer members into an engaged position wherein the smoothie receptacle is clamped between the two thermal transfer members.

The housing 422 of smoothie chiller unit 420 can be provided with receptacle entry port(s) and receptacle exit ports (such as entry port 430 and discharge port 432 as shown in FIG. 35). The shape and size of the housing 422 can be tailored to the required dimensional space, and the positioning of the receptacle entry port(s) and receptacle exit ports can be arranged in accordance with internal positioning and orientation of the chiller unit 60 housed therein.

Figure 36:
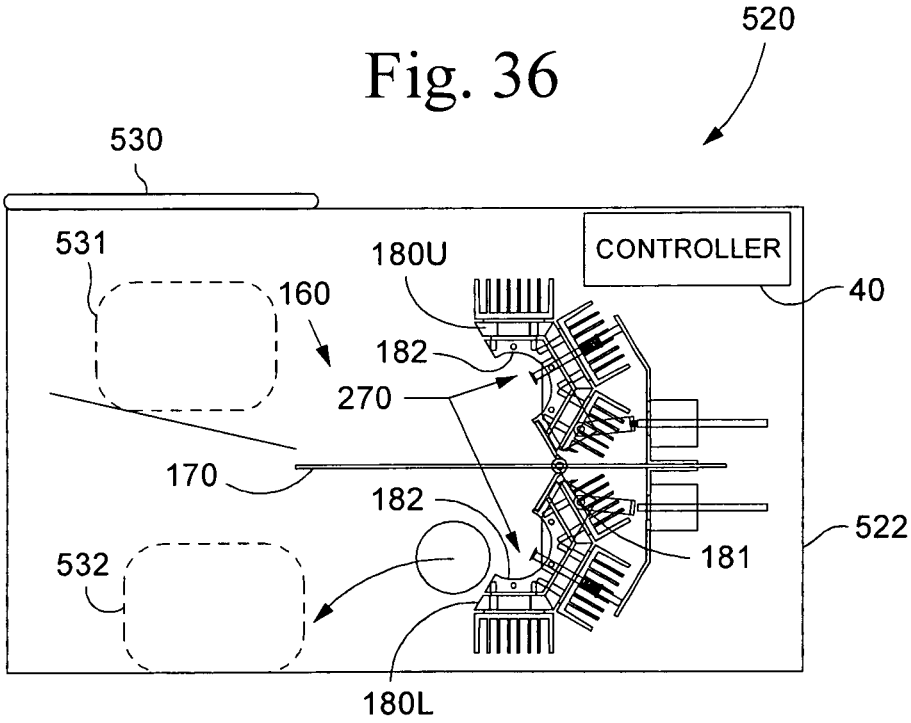
FIG. 36 is a front, partially sectioned view showing another example embodiment of a smoothie chiller unit.

FIG. 36 shows another example embodiment of a smoothie chiller unit 520 which can be sold or installed as a separate unit for use in a dispenser or vending machine, or which can stand alone as a separate chilling unit for chilling smoothie receptacles individually placed therein. The structure and operation of the smoothie chiller unit 520 is similar to that of the embodiment of FIG. 15 as previously described, and thus comprises constituent elements similarly numbered to the foregoing embodiments. The smoothie chiller unit 520 of FIG. 36 thus comprises a chiller unit 160 such as that which is described and operated in the manner understood with reference to FIG. 16A-FIG. 16C. The housing 522 of smoothie chiller unit 520 can be provided with receptacle entry port(s) such as entry port 530 or alternate entry port 531 (shown in broken lines), and can comprise an exit port located on its underside or any other suitable location (such as alternate exit port 532 shown in FIG. 36). As with the previously described embodiment, the shape and size of the housing 522 can be tailored to the required dimensional space, and the positioning of the receptacle entry port(s) and receptacle exit ports can be arranged in accordance with internal positioning and orientation of the chiller unit 160 housed therein.

Figure 37:
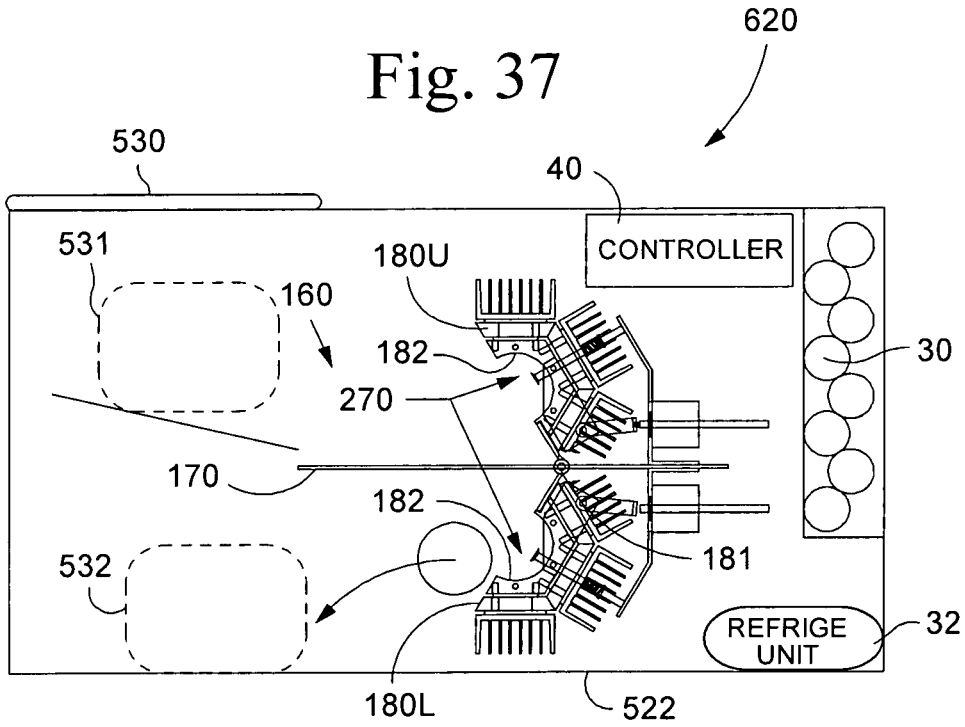
FIG. 37 is a front, partially sectioned view showing yet another example embodiment of a smoothie chiller unit.

FIG. 37 shows yet another example embodiment of a smoothie chiller unit 620 which can be sold or installed as a separate unit. The smoothie chiller unit 620 of FIG. 37 also includes, in a same housing 622 or partitioned part of the same housing, a receptacle storage compartment 630 in which a supply of a limited number (e.g., ten to twelve) smoothie receptacles can be stored. Preferably the receptacle storage compartment 630 is cooled by a refrigeration unit which also located in housing 622. When a consumer desires to enjoy a smoothie, the consumer need only extract a selected smoothie receptacle from the adjacent and auxiliary receptacle storage compartment 630, insert the selected smoothie receptacle into a entry port of the smoothie chiller unit 620; provide (via an operator panel or the like) a start instruction; and then remove the chilled selected smoothie receptacle at the end of the discharge cycle. The smoothie chiller units described herein can thus be employed either for commercial or non-commercial (e.g., private or residential) use.

Figure 38:
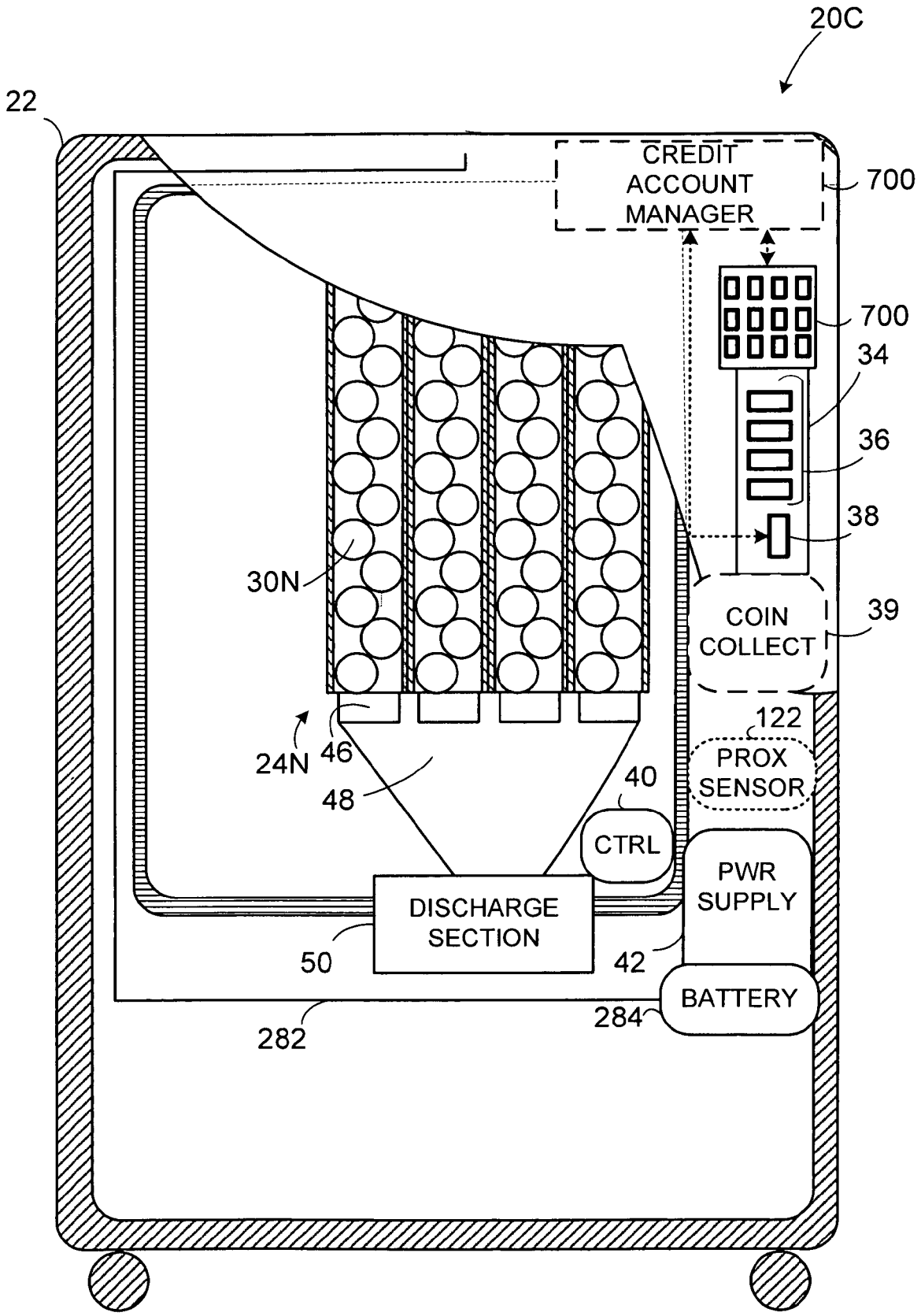
FIG. 38 is a front, partially sectioned view of an example embodiment of a generic vending machine which has credit account management features.

In one of its aspects the technology disclosed herein encompasses a generic vending machine which comprises a credit account management system. FIG. 38 shows an example embodiment of vending machine 20C which resembles in many respects the vending machines/dispensers herein described as comprising (for example) a frame 22, receptacle storage section 24; consumer-operated product selection unit 34; payment receipt mechanism 38; controller 40; and power supply 42. Since vending machine 20C is a generic machine, vending machine 20C can be used to dispense any appropriate merchandise, such as food or beverage, for example. Therefore, depending on the type of merchandise or product dispensed, the vending machine 20C may or may not include a refrigeration unit.

FIG. 38 particularly shows credit account management system 700 which operates in conjunction with payment receipt mechanism 38 and data entry/display device 702. The data entry/display device 702 can take the form of a keypad or keyboard, for example. When the payment receipt mechanism 38 receives payment via an electronic card such as a credit card or debit card, for example, the credit account management system 700 can interact with the consumer or patron via the data entry/display device 702. Through interaction with the customer or patron, the credit account management system 700 can inquire whether the customer or patron desires to engage in one purchase transaction (e.g., purchase one item) with the vending machine, or whether the customer or patron desires to pre-pay any of several permitted prepayment amounts and thereby build a credit balance that can be utilized at the vending machine initially hosting the transaction or any vending machine that participates in a same network with the vending machine which hosts the initial transaction.

Figure 39:
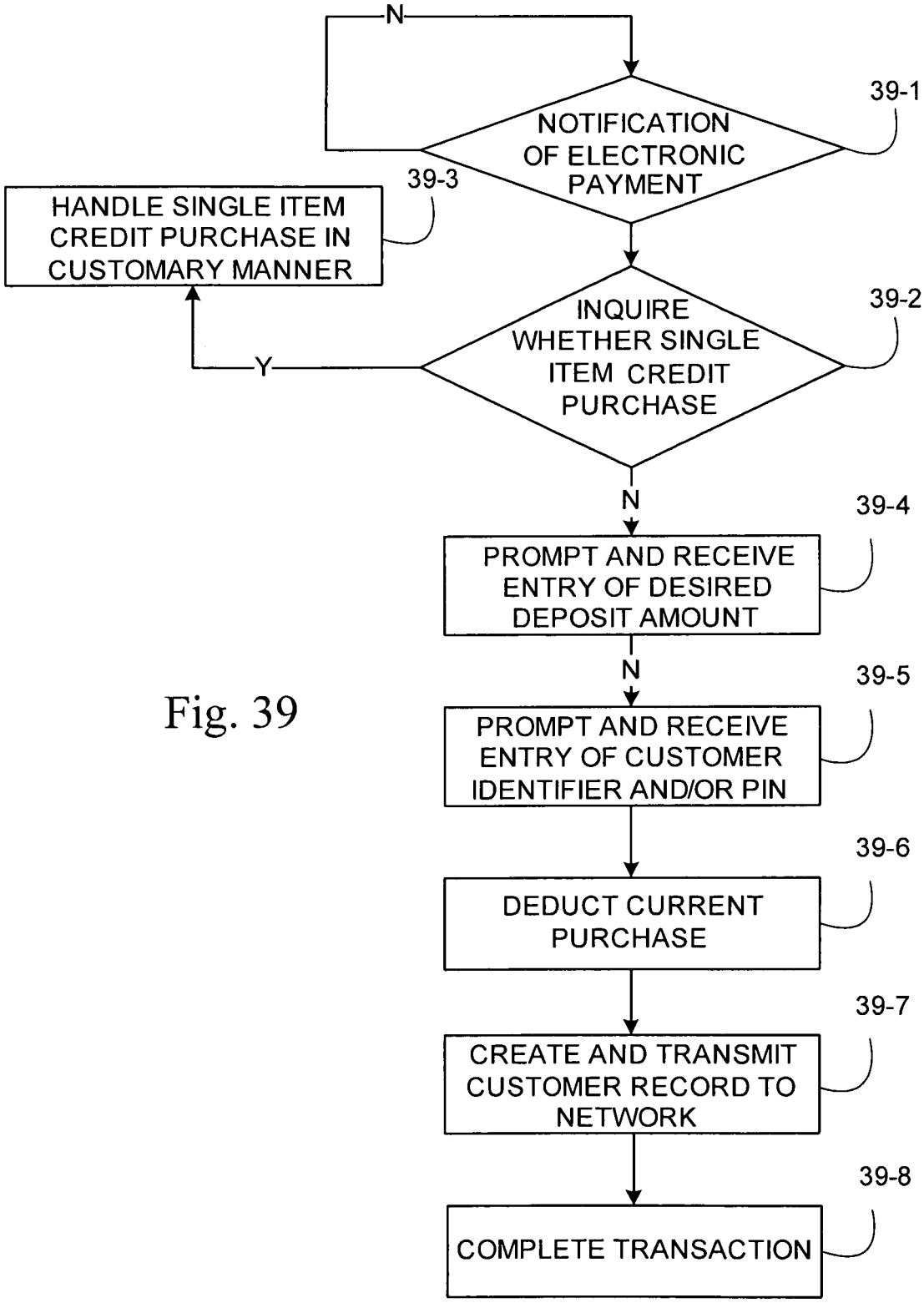
FIG. 39 is a flowchart showing basic acts or steps comprising a method of credit account management for the vending machine of FIG. 38.

FIG. 39 illustrates example acts or steps that can be performed in conjunction with interaction between credit account management system 700 and a customer or patron. As act 39-1 the credit account management system 700 is notified of insertion or use of an electronic payment article (e.g., a credit card or debit card). As act 39-2, the credit account management system 700 checks whether the customer has interest in purchase of one item only. If so, as act 39-3 the electronic purchase of one item is handled in customary fashion. If not, as act 39-4 the credit account management system 700 prompts and receives (e.g., via data entry/display device 702) an desired amount which the customer desires to put on deposit with a vending network to which vending machine 20C belongs or participates. Upon receiving the deposit amount, as act 39-5 the credit account management system 700 further prompts for and receives (e.g., via data entry/display device 702) a customer identifier and/or PIN and/or password. As act 39-6, the credit account management system 700 determines whether a current purchase is desired and, if so, deducts an appropriate amount for the current purchase. As act 39-7, the credit account management system 700 creates a record for the customer (including customer identifier and/or PIN and/or password and deposit amount [less any current purchase]) and forwards the record to the vending machine network before completing the transaction (act 39-8).

Figure 40:
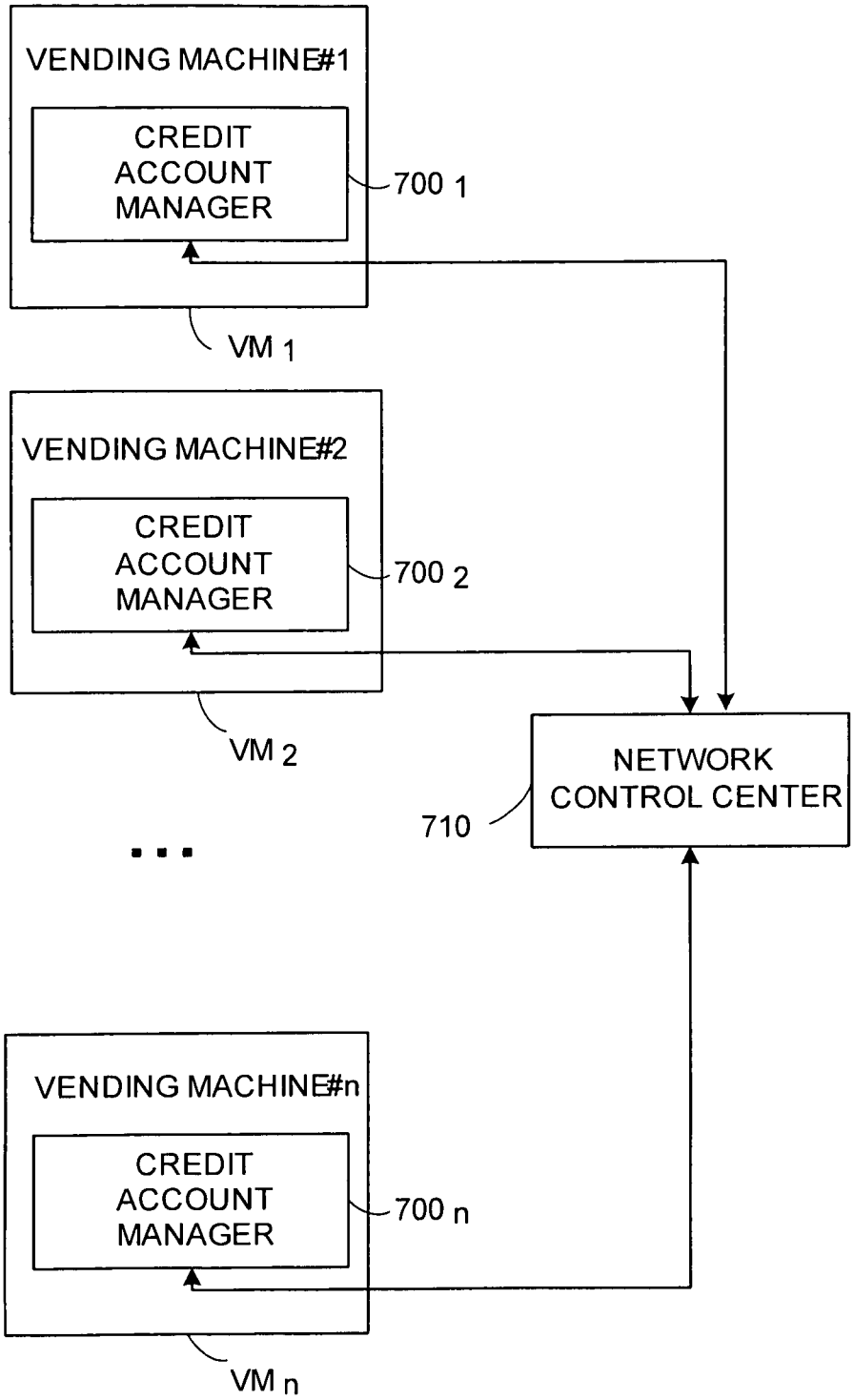
FIG. 40 is a diagrammatic view showing a network of vending machines which participate in a credit account management system.

The network to which the credit account management system 700 belongs or with which it participates can be of any suitable type, and can engage in communications with wireless or wired connections. For example, FIG. 40 shows vending machines $VM_1$ through $VM_n$, each having a comparable credit account management system 700, which are connected to a network control center 710. Alternatively, the vending machines can be connected in ringed or other configuration.

After a patron to build a deposit balance with the network through an interaction such as that depicted by FIG. 39, the patron may subsequently obtain the vended product(s) at other vending machines of the network without needing to have funds or electronic payment cards on the person. Therefore, patron may go out jogging, walking, golfing, fishing, camping, etc. without any need to carry a wallet, change, or credit cards. The patron can approach a vending machine of the network, enter his or her identifier and/or PIN and/or password, and then order the vended product. The vending machine hosting the transaction uses the information entered by the customer to authenticate the customer, checks the customer's balance with the network control center (or with a local version of the customer's record), deducts the cost of the current transaction from the customer's balance, updates the customer's record, and permits delivery of the requested product to the customer. Advantageously the customer is able to obtain the desired product from the vending machine without having to have payment medium at the time of obtaining the product.

For example, a customer can enter a password at any networked vending machine and, upon inserting an electronic payment card, the consumer can enter $100 (for example). A memory chip inside the credit account management system 700 can register the customer's password along with a $100 deposit in account. Thereafter, the consumer can access a network vending machine and thereby have access to a vended product (e.g., a smoothie, by way of non-limiting example) without further payment at any premise having a networked vending machine.

It should be appreciated that, of the example embodiments which happen to concern smoothie dispensers, those smoothie dispensers operate upon the premise that the smoothie beverage itself has already been prepared according to a vendor's formulation and sealed within the smoothie receptacle. The smoothies beverages contained in the smoothie dispensers can be of different flavors or brands, such as blue/raspberry/banana, strawberry/banana, peach, and watermelon/kiwi, just to name a few. Each flavor/brand has been prepared according to its own proprietary formulation, with the ingredients combined and mixed well together. It should be noted that sugars lower the freezing point of the formulation, and pulps can impact the ice crystal formation process. Preferably the ingredients are pasteurized by, e.g., heating to an elevated temperature such as 190 degrees or higher, for example, poured into the smoothie receptacle 30 and cooled (e.g., to room temperature), and then stocked into the bins of smoothie receptacle storage section 24.

It will be appreciated that features of the various embodiments described herein can be combined or utilized disjunctively without other features. For example, where appropriate one or more of the acts of FIG. 28 can also be performed for or in conjunction with the embodiment of FIG. 2 and method mode of FIG. 14, and conversely one or more of the acts of FIG. 14 can also be performed for the or in conjunction with the embodiment of FIG. 15 and method mode of FIG. 28. Moreover, the smoothie dispenser 20S and the smoothie dispenser 20A need not necessarily have their chiller sections configured to be "receptacle conformed".

In the embodiments herein described the thermoelectric cooling modules can take any suitable form. In one example implementation, the thermoelectric cooling modules are those commercially available from Tellurex Corporation as one or more of the following module numbers: C1-1.0-127-1.27; C1-1.4-127-1.65; C1-1.4-127-1.14; or C1-1.4-219-1.14. See also, e.g., International Standards Organization 9001:2000. In some instances the thermoelectric cooling modules can be obtained to include a graphite foil conformal coating which, when compressed, fills in the small irregularities between the thermoelectric cooling modules and an aluminum member such as thermal transfer member 80 or thermal transfer members 180. The sandwich of FIG. 27 is preferably assembled with stainless steel socket-head machine screws 202 insulated with heat-shrink tubing and fiber washers to minimize back heat flux.

In other embodiments the receptacle conformed chiller sections need not necessarily comprise cooling modules which are mounted to the thermal transfer members. For example, heat transfer may be effected by other means of such as contact with other refrigeration means such as refrigeration tubes or direct or indirect contact with refrigerant, for example liquid nitrogen.

The smoothie dispensers and method described herein provide, e.g., solid state beverage preparation arid delivery technology utilizing advanced Thermal Electric cooling chips to provide a quick chill to a smoothie receptacle filled with smoothie contents. As the receptacle is chilled, a vibrator mechanism agitates the contents to isolate ice crystals. When the beverage contents reach a predetermined temperature the quick chill cycle is terminated opening the chiller plate clamp freeing the beverage to slide down into the vendor delivery chute to the patron. To ensure a no stick "can to chiller plate" condition the agitator is left on until the beverage is fully expelled from the receptacle conformed chiller section. In an example embodiment, the receptacle conformed chiller section is disposed on a 20 degree forward downward slope to exploit the benefit of gravity to expel the prepared beverage from the preparation unit to the patron.

The example embodiments facilitate an advanced, practical, and quality smoothie preparation process. The embodiments disclosed herein promote a fast smoothie preparation process by virtue, e.g., of receptacle diameter-matching aluminum thermal transfer members (e.g., aluminum heat exchangers) which, coupled with thermoelectric cooling modules (e.g., thermoelectric chips) form a highly efficient conformal heat pump. This heat pump removes heat from the smoothie until its contents reaches an ideal sub-freezing temperature that will depend upon smoothie formulation. The embodiments of the smoothie dispensers disclosed herein are very flexible in configuration, allowing prep cycle and temperature experimentation.

The technology disclosed herein quickly provides post production or secondary processing to the pre-containerized or pre-canned smoothie product. This secondary processing includes routing the selected smoothie receptacle from the vendor's stock can drop mechanisms (e.g., smoothie receptacle storage section 24) into the receptacle conformed chiller section where the can is accepted, clamped within two opposing quick chill thermal transfer members, agitated, then upon processing completion, the smoothie receptacle is released and forwarded into the vendor's stock delivery chute into discharge section just like an ordinary chilled beverage.

The smoothie secondary processing as described herein can take 30 to 60 seconds depending on ambient vendor temperatures. The required cooling is not for entirely freezing the beverage, but only for creating a desired percentage of ice crystals in the liquid. The technology disclosed herein minimizes the time it takes to route, capture, process, and deliver the finished product. The single largest time factor in this process is the quick chill operation which relies upon a high contact area heat pump using high reliability solid state thermo-electric cooler chips. The thermo-electric chips are thermally directly coupled to the smoothie product can via a pair of low thermal mass aluminum plates with an internal diameter matching that of the smoothie product receptacle. To minimize the quick chill cycle the chill plates are kept at a reasonable standby temperature.

The embodiments described herein afford a compact modular design ideal for both factory and retrofit installation. The embodiments disclosed herein can meet regulatory compliance requirements using all low voltage components and vending industry standard components can be used where possible.

To keep service costs to a minimum the smoothie dispensers encompassed hereby can be on-site swappable and serviceable. Quick disconnect connectors can be employed to accommodate a speedy swap out.

The embodiments described herein can be shielded from ingress of moisture to preclude explosion of pressurized substances.

Since many vendors reside inside office areas where machine noise has to be kept at a minimum, the embodiments described herein can be very quiet using no pneumatic air cylinders or solenoids that emit air burst and hammer noise.

Advantageously, the embodiments described herein and encompassed hereby utilize thermoelectric devices to chill a semi-frozen beverage for on-demand machine vending. The modular chiller units as described in the example embodiments (including, e.g., chiller unit 60 and chiller unit 160) may be marketed as a counter-top device for home or café use, or retrofit into base of existing beverage vending machines in place of typical compressor and refrigeration equipment. In addition, in example embodiments the smoothie dispensers described herein use vibration to redistribute liquid inside the can during chilling, both to accelerate chilling by bring warmer solution in contact with the cold inner can surface, and to aid in the formation of small ice crystals typical of a smoothie beverage.

Optional energy-efficiency features attending the technology disclosed herein include but are not limited to the following:

On-demand chilling using energy only when required for vending rather than continually maintaining low product temperature.

In some example embodiments, use of a solar-cell panel (e.g., on top or sidewalls) on vending machine, with and battery inside to provide a completely energy-independent stand-alone vending machine.

Energy demand will typically have a short, high-current cycle when vending, with long intervals of low energy use allowing for recharging.

In hot locations, the abundance of solar energy may permit a second, internal TE space-cooling unit to maintain low storage temperature inside the vending machine (e.g., for cooling smoothie receptacle storage section 24), thereby reducing the on-demand chilling requirements.

With suitable built-in systems, wireless networked inventory control and merchant transaction operations are possible.

Although the description above contains many specificities, these should not be construed as limiting the scope of the invention but as merely providing illustrations of some of the presently preferred embodiments of this invention. Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A smoothie dispenser comprising:

a frame;

a smoothie receptacle storage section provided within the frame and configured to house plural smoothie receptacles at a first temperature;

a chiller section arranged to receive a selected smoothie receptacle released from the smoothie receptacle storage section and configured to crystallize contents of the selected smoothie receptacle, the chiller section comprising:

a thermal transfer assembly configured to lower temperature contents of the selected smoothie receptacle to a second temperature for crystallizing the contents of the selected smoothie receptacle, the thermal transfer assembly comprising:

a thermal transfer member comprising a receptacle contact surface configured to conform to at least a portion an exterior profile of the selected smoothie receptacle and a thermal transfer surface;

cooler coupled to the thermal transfer surface;

an agitator configured to agitate the thermal transfer assembly during lowering of the temperature of the contents of the selected smoothie receptacle;

wherein the thermal transfer surface is a module mating surface and wherein the cooler is a thermoelectric cooling module mounted on the module mating surface of the thermal transfer member;

wherein the thermal transfer assembly further comprises: two thermal transfer members;

an actuator configured to move the two thermal transfer members into an engaged position wherein the selected smoothie receptacle is clamped between the two thermal transfer members.

2. The apparatus of claim 1, wherein the receptacle contact surface is configured to conform to at least a portion an arcuate exterior profile of the selected smoothie receptacle.

3. The apparatus of claim 1, further comprising a controller configured to initiate and terminate a chill cycle wherein the contents of the selected smoothie receptacle are lowered to the second temperature for crystallizing the contents of the selected smoothie receptacle.

4. The apparatus of claim 3, wherein the controller is configured to operate the actuator to clamp the selected smoothie receptacle between the two thermal transfer members.

5. The apparatus of claim 1, wherein the actuator is configured to reciprocate the two thermal transfer members into the engaged position.

6. The apparatus of claim 1, wherein at least one of the two thermal transfer members is configured to pivot into the engaged position upon actuation of the actuator.

7. The apparatus of claim 6, wherein the thermal transfer assembly further comprises a mounting plate, wherein a first of the two transfer members is mounted for location on a first side of the mounting plate and a second of the two transfer members is pivotally mounted for location on a second side of the mounting plate, and wherein the mounting plate is configured with a cavity therein to accommodate the selected smoothie receptacle when clamped between the two thermal transfer members.

8. The apparatus of claim 7, wherein the first of the two transfer members is pivotally mounted for location on the first side of the mounting plate and the second of the two transfer members is pivotally mounted for location on the second side of the mounting plate.

9. The apparatus of claim 7, wherein the actuator is mounted on the mounting plate.

10. The apparatus of claim 1, wherein the thermal transfer member comprises plural module mating surfaces and corresponding plural thermoelectric cooling modules mounted on the respective plural module mating surfaces.

11. The apparatus of claim 1, further comprising a finned heat exchanger connected to the thermoelectric cooling module.

12. The apparatus of claim 1, further comprising a receptacle ejector configured to eject the selected smoothie receptacle from the thermal transfer member, and wherein the thermal transfer member is configured to accommodate the receptacle ejector at least partially within the thermal transfer member.

13. The apparatus of claim 1, wherein the agitator comprises an eccentrically weighted motor attached to the thermal transfer assembly.

14. A smoothie dispenser comprising:

a frame;

a smoothie receptacle storage section provided within the frame and configured to house plural smoothie receptacles at a first temperature;

a chiller section arranged to receive a selected smoothie receptacle released from the smoothie receptacle storage section and configured to crystallize contents of the selected smoothie receptacle, the chiller section comprising:

a thermal transfer assembly configured to lower temperature contents of the selected smoothie receptacle to a second temperature for crystallizing the contents of the selected smoothie receptacle, the thermal transfer assembly comprising:

a thermal transfer member comprising a receptacle contact surface configured to conform to at least a portion an exterior profile of the selected smoothie receptacle and a thermal transfer surface;

cooler coupled to the thermal transfer surface;

an agitator configured to agitate the thermal transfer assembly during lowering of the temperature of the contents of the selected smoothie receptacle;

wherein the thermal transfer surface is a module mating surface and wherein the cooler is a thermoelectric cooling module mounted on the module mating surface of the thermal transfer member;

a controller configured to initiate and terminate a chill cycle wherein the contents of the selected smoothie receptacle are lowered to the second temperature for crystallizing the contents of the selected smoothie receptacle;

a temperature sensor configured to monitor the temperature of the selected smoothie receptacle and generate a signal in accordance therewith, and wherein in response to the signal provided by the temperature monitor the controller is configured to initiate and terminate the chill cycle.

15. A smoothie dispenser comprising:

a frame;

a smoothie receptacle storage section provided within the frame and configured to house plural smoothie receptacles at a first temperature;

a chiller section arranged to receive a selected smoothie receptacle released from the smoothie receptacle storage section and configured to crystallize contents of the selected smoothie receptacle, the chiller section comprising:

a thermal transfer assembly configured to lower temperature contents of the selected smoothie receptacle to a second temperature for crystallizing the contents of the selected smoothie receptacle, the thermal transfer assembly comprising:

a thermal transfer member comprising a receptacle contact surface configured to conform to at least a portion an exterior profile of the selected smoothie receptacle and a thermal transfer surface;

cooler coupled to the thermal transfer surface;

an agitator configured to agitate the thermal transfer assembly during lowering of the temperature of the contents of the selected smoothie receptacle;

wherein the thermal transfer surface is a module mating surface and wherein the cooler is a thermoelectric cooling module mounted on the module mating surface of the thermal transfer member;

a controller configured to initiate and terminate a chill cycle wherein the contents of the selected smoothie receptacle are lowered to the second temperature for crystallizing the contents of the selected smoothie receptacle;

wherein the controller is configured to reverse operation of the thermoelectric cooling module and thereby defrost the thermal transfer member for facilitating release of the selected smoothie receptacle.

16. A smoothie dispenser comprising:

a frame;

a smoothie receptacle storage section provided within the frame and configured to house plural smoothie receptacles at a first temperature;

a chiller section arranged to receive a selected smoothie receptacle released from the smoothie receptacle storage section and configured to crystallize contents of the selected smoothie receptacle, the chiller section comprising:

a thermal transfer assembly configured to lower temperature contents of the selected smoothie receptacle to a second temperature for crystallizing the contents of the selected smoothie receptacle, the thermal transfer assembly comprising:

a thermal transfer member comprising a receptacle contact surface configured to conform to at least a portion an exterior profile of the selected smoothie receptacle and a thermal transfer surface;

cooler coupled to the thermal transfer surface;

an agitator configured to agitate the thermal transfer assembly during lowering of the temperature of the contents of the selected smoothie receptacle;

wherein the thermal transfer surface is a module mating surface and wherein the cooler is a thermoelectric cooling module mounted on the module mating surface of the thermal transfer member;

a finned heat exchanger connected to the thermoelectric cooling module;

an auxiliary thermal transfer member connected to the thermoelectric cooling module;

an auxiliary thermoelectric cooling module connected between the auxiliary thermal transfer member and the finned heat exchanger.

17. A smoothie dispenser comprising:

a frame;

a consumer-operated product selection unit provided on the frame configured to receive customer input for specifying choice of a selected smoothie receptacle and customer input for selecting a smoothie additive, the smoothie additive comprising a substance appropriate for introduction into contents of the selected smoothie receptacle by the customer after discharge of the selected smoothie receptacle from the dispenser;

a smoothie receptacle storage section provided within the frame and configured to house plural smoothie receptacles at a first temperature;

a smoothie additive storage section provided within the frame and configured to house the smoothie additive;

a chiller section arranged to receive a selected smoothie receptacle released from the smoothie receptacle storage section and configured to crystallize contents of the selected smoothie receptacle by lowering the temperature of the contents of the selected smoothie receptacle to a second temperature;

an additive discharge mechanism configured to separately discharge the selected smoothie additive into an additive discharge section of the frame in coordination with discharge of the chilled selected smoothie receptacle into a receptacle discharge section.

18. The apparatus of claim 17, wherein the consumer-operated product selection unit is configured to receive customer input for optionally selecting the smoothie additive.

19. The apparatus of claim 17, wherein the consumer-operated product selection unit is configured to receive customer input for selecting one of plural possible types of smoothie additives, and wherein the smoothie additive storage section is configured to and house the plural possible types of smoothie additives.

20. The smoothie dispenser of claim 17, wherein the smoothie additive is for separate discharge into the additive discharge section of the frame.

21. The smoothie dispenser of claim 17, wherein the smoothie additive is a vitamin supplement or a health supplement.

22. A method of operating a smoothie dispenser comprising:

releasing a selected smoothie receptacle from a smoothie receptacle storage section into a chiller section;

in the chiller section:

moving a first heat transfer member so that the first heat transfer member and a second heat transfer member substantially surround and contact a periphery of the selected smoothie receptacle in receptacle conforming manner so that the first heat transfer member and the second heat transfer member have substantially greater than linear contact with the smoothie receptacle;

chilling the selected smoothie receptacle by performing a heat transfer operation through contact between the thermal transfer members and the smoothie receptacle; and agitating the selected smoothie receptacle during the heat transfer operation.

23. A method of operating a smoothie dispenser comprising:

releasing a selected smoothie receptacle from a smoothie receptacle storage section into a chiller section;

in the chiller section:

using a thermoelectrically cooled heat transfer member to substantially surround and contact a periphery of the selected smoothie receptacle in receptacle conforming manner;

chilling the selected smoothie receptacle by performing a heat transfer operation through the thermal transfer member; and agitating the selected smoothie receptacle during the heat transfer operation.

* * * * *